US008166987B2

(12) United States Patent
Weaver

(10) Patent No.: US 8,166,987 B2
(45) **Date of Patent: *May 1, 2012**

(54) SYSTEMS AND METHODS FOR ASSISTING A SEATED PERSON TO A STANDING POSITION

(75) Inventor: Craig E. Weaver, Crossville, TN (US)

(73) Assignee: WeCare Products, Inc. USA, Crossville, TN (US)

( * ) Notice: Subject to any disclaimer, the term of this patent is extended or adjusted under 35 U.S.C. 154(b) by 322 days.

This patent is subject to a terminal disclaimer.

(21) Appl. No.: 12/024,506

(22) Filed: Feb. 1, 2008

(65) Prior Publication Data

US 2008/0121259 A1 May 29, 2008

Related U.S. Application Data

(63) Continuation-in-part of application No. 11/201,737, filed on Aug. 11, 2005, now Pat. No. 7,363,931.

(60) Provisional application No. 60/625,085, filed on Nov. 5, 2004.

(51) Int. Cl.
*A61H 3/04* (2006.01)
*A61G 5/14* (2006.01)

(52) U.S. Cl. ..... 135/67; 135/85; 5/86.1; 280/650; 280/87.021

(58) Field of Classification Search ..... 135/65–67, 135/85, 75; 280/647, 650, 655.1, 87.021, 280/47.17, 87.041; 5/81.1 R, 83.1, 86.1; 482/67

See application file for complete search history.

(56) References Cited

U.S. PATENT DOCUMENTS

| | | | |
|---|---|---|---|
| 2,374,182 | A | 4/1945 | Duke |
| 2,759,525 | A | 8/1956 | Ries |
| 2,785,731 | A | 3/1957 | Welsh |
| 2,855,024 | A | 10/1958 | Robb |
| 3,041,636 | A | 7/1962 | Twedt |
| 3,432,162 | A | 3/1969 | Flemming |
| 3,455,313 | A | 7/1969 | King |
| 3,529,819 | A | 9/1970 | Blank |
| 4,094,331 | A | 6/1978 | Rozsa |
| 4,135,535 | A | 1/1979 | Thomas |
| 4,211,309 | A | 7/1980 | Ruggiero |

(Continued)

FOREIGN PATENT DOCUMENTS

FR 2625899 7/1989

(Continued)

OTHER PUBLICATIONS

International Search Report for PCT/US2009/032628 dated Aug. 12, 2010.

(Continued)

*Primary Examiner* — Winnie Yip
(74) *Attorney, Agent, or Firm* — Sutherland Asbill & Brennan LLP

(57) ABSTRACT

A walker device including a walking aid and a lifting arm attached to, and extending in an approximate vertical direction from, the walking aid. The walking aid may include two front legs and two back legs. The walking aid may include two or more wheels attached to the bottom of the two front legs and/or two back legs. The walking aid may be a multiple-legged cane. The walking aid may be a wheeled mobility device. The lifting arm may include a gripping handle positioned at its approximate distal end.

14 Claims, 28 Drawing Sheets

U.S. PATENT DOCUMENTS

| | | | | | |
|---|---|---|---|---|---|
| 4,212,493 | A | | 7/1980 | Ledesky | |
| 4,251,105 | A | | 2/1981 | Barker | |
| 4,335,900 | A | * | 6/1982 | Fleischer | 280/649 |
| 4,341,381 | A | * | 7/1982 | Norberg | 482/67 |
| 4,411,283 | A | | 10/1983 | Lucarelli | |
| 4,474,202 | A | | 10/1984 | Blechner | |
| 4,700,730 | A | | 10/1987 | Samuelson et al. | |
| 4,729,395 | A | | 3/1988 | Adamson | |
| 4,748,994 | A | | 6/1988 | Schultz et al. | |
| 4,777,973 | A | | 10/1988 | Nakajima | |
| 4,941,496 | A | | 7/1990 | Berning | |
| 4,993,446 | A | | 2/1991 | Yarbrough | |
| 5,189,741 | A | | 3/1993 | Beardmore | |
| 5,224,717 | A | | 7/1993 | Lowen | |
| 5,305,773 | A | | 4/1994 | Browning | |
| 5,320,122 | A | | 6/1994 | Jacobson, II et al. | |
| 5,347,666 | A | | 9/1994 | Kippes | |
| 5,364,120 | A | | 11/1994 | Shimansky | |
| 5,449,013 | A | | 9/1995 | Landers | |
| 5,499,645 | A | | 3/1996 | Baliga | |
| 5,649,558 | A | | 7/1997 | Richard | |
| 5,687,984 | A | * | 11/1997 | Samuel | 280/641 |
| 5,716,063 | A | * | 2/1998 | Doyle et al. | 280/87.05 |
| 5,785,070 | A | | 7/1998 | Block et al. | |
| 5,853,015 | A | | 12/1998 | Evans | |
| 5,950,258 | A | | 9/1999 | Deyne et al. | |
| 5,954,075 | A | | 9/1999 | Gilmour | |
| 5,983,421 | A | | 11/1999 | Walser | |
| 5,983,911 | A | | 11/1999 | Steele | |
| 6,044,507 | A | | 4/2000 | Smith | |
| 6,082,384 | A | | 7/2000 | Cheng | |
| 6,099,002 | A | | 8/2000 | Uchiyama | |
| 6,148,448 | A | | 11/2000 | Urso | |
| 6,213,672 | B1 | | 4/2001 | Varga | |
| 6,244,285 | B1 | | 6/2001 | Gamache | |
| 6,276,007 | B1 | | 8/2001 | Brown | |
| 6,308,981 | B1 | * | 10/2001 | Proehl | 280/657 |
| 6,386,575 | B1 | * | 5/2002 | Turner | 280/647 |
| 6,503,176 | B2 | | 1/2003 | Kuntz | |
| 6,615,432 | B1 | | 9/2003 | Blaylock | |
| 6,705,336 | B2 | | 3/2004 | Goligorski | |
| 6,733,018 | B2 | | 5/2004 | Razon | |
| D494,109 | S | | 8/2004 | Karasin et al. | |
| 6,851,751 | B1 | | 2/2005 | Romero et al. | |
| 6,961,967 | B1 | | 11/2005 | Brown | |
| 7,011,335 | B2 | * | 3/2006 | Kight | 280/655.1 |
| 7,032,911 | B1 | * | 4/2006 | Shellenberger | 280/47.38 |
| 7,077,423 | B2 | * | 7/2006 | Hutchinson | 280/649 |
| 7,396,038 | B2 | * | 7/2008 | Zweideck | 280/642 |
| 2003/0111100 | A1 | | 6/2003 | Bell et al. | |

FOREIGN PATENT DOCUMENTS

| | | | | |
|---|---|---|---|---|
| GB | 1373593 | | | 11/1974 |
| GB | 2061118 | A | * | 5/1981 |
| GB | 2098935 | A | | 12/1982 |
| GB | 2140773 | A | | 12/1984 |

OTHER PUBLICATIONS

PCT Notification of Transmittal of The International Search Report and The Written Opinion of The International Searching Authority, or the Declaration, PCT/US2009/032628, mailed Apr. 7, 2009.

* cited by examiner

SYSTEMS AND METHODS FOR ASSISTING A SEATED PERSON TO A STANDING POSITION

RELATED APPLICATIONS

The present application is a continuation-in-part of U.S. patent application Ser. No. 11/201,737, filed Aug. 11, 2005 now U.S. Pat. No. 7,363,931, which is a non-provisional of U.S. Patent Application No. 60/625,085, filed Nov. 5, 2004, both of which are hereby incorporated by reference as if set forth fully herein.

TECHNICAL FIELD

This present invention relates generally to methods and systems for assisting a seated person to a standing position.

BACKGROUND OF THE INVENTION

Many persons require assistance to stand from a seated position. Generally, these persons have a disability, are infirm because of age, are recovering from illness or surgical procedure, or have some other type of condition that limits their ambulatory capabilities. Certain methods and systems for assisting persons to stand from a seated position are known and available to such persons.

Of course, the most simple of these known methods likely is to physically lift the person without the aid of any devices. This method, though, has many shortcomings. Many persons who require standing assistance may not have available to them a person who is physically capable of lifting them from a seated position. Even where such a person is available, physical lifting often causes injury to the lifter because the lifter is required to lift too much weight or lift from an awkward position. Further, the infirm person receiving the lift also is at risk, as such lifting often causes skin tears and creates unstable situations that result in falls.

More complicated methods and systems also have been described. For example, a full body sling lift has been available for many years. Generally, these types of lifts are used for persons who have no weight bearing ability in their legs. While such devices may be useful in certain applications, they are difficult and time consuming to use. Further, these devices generally are not appropriate for persons who have some ambulatory capabilities and only require assistance to stand.

Sit/stand lifts also have been available in the market place for many years. A person who might benefit from this type of lift generally has upper arm strength and minimal weight bearing ability. The purpose of the sit/stand lift is to transfer a person from a sitting position to another sitting position or to the bed side. These types of lifts, however, are cumbersome and time consuming to use. As a result, a caregiver is tempted to manually help an infirm person to a standing position, which, as described above, may cause injury to the lifter or the person being lifted. A sit/stand lift also does not adequately meet the needs of the persons who only require help standing so that they may use a walker. Further, sit/stand lifts are often expensive, bulky, difficult to store, hard to maneuver in small areas, and difficult and time consuming to use.

Another option available to caregivers is a gate belt. Generally, a gate belt may be used to help a person attain a standing position so that they may use a walker or pivot to another sitting position. While gate belts may be effective for certain applications, they still tend to create an unstable situation during the lifting for the caregiver and person being lifted that leads to frequent falls and injuries. Further, the amount of weight the caregiver is required to lift is often unsafe and beyond Occupational Safety and Health Administration ("OSHA") guidelines. The risk of injury is further heightened due to the twisting and ergonomically unsafe positioning that occurs during a gate belt lift.

As a result, there is a long-felt need for a better method to help infirm and other persons stand from a seated position.

SUMMARY OF THE INVENTION

The present application thus may describe a system for assisting a seated person to stand that may include a walker and a lifting arm attached to the walker that extends in an approximate vertical direction from the walker. The walker may include two front legs and two rear legs, and the lifting arm may extend telescopically from one of the front legs. A footpad may be attached to the bottom of one of the front legs. The footpad may be attached by a hinged connector.

The lifting arm may be adjustable between two or more positions of extension. The two or more positions of extension may include an extended position wherein the lifting arm is fully extended above the one front leg. The two or more positions of extension further may include a non-extended position where the majority of the length of the lifting arm is contained inside one of the front legs. The system further may include openings in the lifting arm that engage a pin connected to the front legs. Each opening may correspond to one of the two or more positions of extension such that when the lifting arm slides telescopically between the two or more positions of extension, the corresponding opening is engaged by the pin. The system further may include a guide channel in the lifting arm that maintains alignment between the openings and the pin when the lifting arm is being slid between the two or more positions of extension.

In some embodiments, the lifting arm may include a vertical member that extends telescopically in an approximate vertical direction from each of the front legs. A horizontal connector may connect the two vertical members. The lifting arm of this embodiment similarly may be adjustable between two or more positions of extension. An actuator may disengage a pin of each front leg from respective openings in the vertical members to allow the vertical members to slide telescopically. The actuator may located on a cross support of the walker.

In some embodiments, one or more connectors may connect the vertical members of the lifting arm to the front Legs. The connectors may connect the vertical members to the front legs such that a lower portion of each of the vertical members resides adjacent to one of the front legs and each of the vertical members is orientated in a direction that is substantially parallel to one of the front legs. A lifting arm that is connected in this manner may be adjustable between two or more positions of extension. The connector may include two openings (an arm opening that is sized to fit around one of the vertical members of the lifting arm and a leg opening that is sized to fit around one of the front legs), means for laterally adjusting the arm opening in relation to the leg opening, and means for tightening the arm opening and the leg opening to secure the vertical member in a desired position relative to the front leg.

In other embodiments, the systems may include a hinged connector for connecting the lifting arm to one or more of the front legs. The hinged connector may include a closed position and an open position. In the closed position, the lifting arm may reside substantially adjacent and substantially parallel to at least one of the front legs. When the hinged connector is in the open position the lifting arm may extend above the front legs in an approximate vertical direction. The bottom of each of the front legs may include a shoe. The bottom surface of the shoe may be arcuate in shape.

The present invention further may include a device for attaching to a walker for assisting a sitting person to stand. The device may include a lifting arm that includes two vertical members and a horizontal connector that connects the two vertical members and one or more connectors for connecting the vertical members to the front legs of the walker. The connectors may connect the vertical members to the front legs such that a lower portion of each of the vertical members resides adjacent to one of the front legs and each of the vertical members is orientated in a direction that is substantially parallel to one of the front legs. The connectors may be similar to those described above. The lifting arm may be adjustable between two or more positions of extension.

The present invention further may include a method for assisting a seated person to stand using a walker with a lifting arm attached to the walker that extends in an approximate vertical direction above the walker. The method may include having the seated person hold onto the walker or the lifting arm and having a helper pull the lifting arm in a direction away from the seated person. The lifting arm may extend telescopically from one of the front legs of the walker. The lifting arm may be adjustable between two or more positions of extension. The method may further include having the helper check the location of the lifting arm and, if the lifting arm is not in an extended position, having the helper adjust the lifting arm to the extended position. The method may further include having the helper adjust the lifting arm to a non-extended position once the seated person is standing.

The lifting arm used in the method may include a vertical member that extends telescopically in an approximate vertical direction from each of the front legs. A horizontal connector may connect the two vertical members. The lifting arm may be adjustable between two or more positions of extension. The vertical members may be connected to the front legs by one or more connectors. The walker further may include a footpad attached to the bottom of one of the front legs. The method further may include having the seated person press one of his feet on the footpad as the helper pulls the lifting arm in the direction away from the seated person. In other embodiments, the method may include having the helper press one of his feet on the footpad as the helper pulls the lifting arm in the direction away from the seated person.

The present invention may be a walker device for assisting a seated person to stand. The walker device may include a walker having a pair of interconnected front legs and a pair of back legs, where each front leg may be connected to a respective back leg by a top support. Each top support of the walker may include a walker handle. Additionally, the walker device may include at least one lifting arm, and, in some embodiments, a first lifting arm and a second lifting arm, attached to approximate ends of the pair of front legs of the walker respectively. The lifting arm or arms may extend at least 12 inches in an approximate vertical direction from the walker and may further include a gripping handle positioned at the lifting arm's approximate distal end. The first lifting arm or arms may be moveable independent of the front legs of the walker. Each lifting arm may be configured to receive one hand of a seated person, who may be seated approximately between the pair of back legs, at a first position and one hand of a helper at a second position. The second position may be approximately above the first position, and sufficiently separated from the first position to produce leverage so that the walker pivots about the front and lifts the back legs when each lifting arm is pulled in a direction away from the seated person by the helper, the lifting arm moves in a direction toward the helper to assist the seated person to a standing position.

In some embodiments, the walking aid may be a wheeled walker including two front legs and two back legs, wherein the two front legs or the two rear legs include wheels positioned at their distal ends. The lifting arm may extend from one of the two front legs. Each of the two front legs may include a wheel attached at the distal ends and a locking mechanism to prevent rotation of the wheels when actuated.

In some embodiments, the walking aid may be a rollator, including two front legs and two rear legs, and two handles extending from the two front legs or the two rear legs in a direction opposite the wheels, wherein each of the two front legs and the two back legs include a wheel attached at the distal ends. In this embodiment, the lifting arm may extend from one of the two front legs. Alternatively, the lifting arm may extend from one of the two handles. Each wheel positioned at the distal ends of the two front legs may include a locking mechanism to prevent rotation of the wheels when actuated.

In some embodiments, the walking aid may be a multiple-legged cane including a vertical member, at least a first leg, a second leg, and a third leg extending in a substantially downward direction from an approximate lower end of the vertical member, and a handle extending from an approximate upper end of the vertical member. At least the first leg, the second leg, and the third leg may form a stable base having at least three support points. The lifting arm may extend in an approximate vertical direction from the approximate upper end of the vertical member. The walking aid may include a first gripping handle and a second gripping handle sufficiently separated from the first gripping handle configured to receive at least one hand of the seated person.

In some embodiments, the lifting arm may be configured to pivot about the point of attachment to the walking aid in an approximate front to back direction, wherein the pivoting allows the lifting arm to be pivoted toward the seated person and toward the helper person. The walking aid may include a first gripping handle and a second gripping handle sufficiently separated from the first gripping handle configured to receive at least one hand of the seated person. The walking aid may include two front legs and two rear legs, and at least one footpad positioned at a distal end of at least one of the two rear legs, wherein the footpad is configured to receive at least one foot of the seated person and hold the walking aid in communication with the ground when the lifting arm is pivoted in a direction away from the seated person. The walking aid may further include an attaching means to secure the lifting arm to at least one point on the walking aid at a position approximately opposite to the point of attachment of the lifting arm to the walking aid.

The present invention may be a mobility device for assisting a user to stand that may be a wheeled mobility device. The wheeled mobility device may include at least three wheels and a seat for receiving the user. The wheeled mobility device may further include a lifting arm attached to a point on the wheeled mobility device configured to receive at least one hand of a helper at a first position and at least one hand of the user at a second position. The first position and the second position may be sufficiently separated to produce sufficient leverage so that when the lifting arm is pulled in a direction away from the seated person by the helper, the lifting arm moves in a direction toward the helper, to assist the seated person to stand. The lifting arm may be configured to pivot about the point of attachment to the wheeled mobility device in an approximate front to back direction, wherein the pivoting allows the lifting arm to pivot toward the seated person and toward the helper person.

In some embodiments, the mobility device may further include at least one lower support structure extending in an approximate downward direction from the wheeled mobility device, wherein the lifting arm is attached to the at least one lower support structure. The mobility device may further include at least one middle support structure supporting the seat, wherein the lifting arm is attached to the at least one middle support structure at an approximate forward position. The wheeled mobility device may be a wheelchair or a motorized scooter, or the like.

The present invention may include a method for manufacturing a walker device for assisting a seated person to stand. The method may include the steps of: providing a walking aid comprising a pair of interconnected front legs, a pair of back legs, each front leg connected to a respective back leg by a top support, each top support including a walker handle; attaching at least one lifting arm extending at least 12 inches in an approximate vertical direction from the walking aid; and affixing a gripping handle to an approximate distal end of the at least one lifting arm configured to receive at least one hand of a helper. The method may further include the step of constructing at least one front leg to receive the at least one lifting arm in an area within the at least one front leg. The lifting arm or arms and the at least one front leg may be operable to allow the at least one lifting arm to telescopically extend from within the at least one front leg. The method may further include the step of removably attaching the lifting arm or arms. The method may further include constructing the at least one lifting arm to comprise a first vertical member, a second vertical member substantially parallel to the first vertical member, and a horizontal connector connecting the first vertical member and the second vertical member, and attaching a distal end of the first vertical member to one of the front legs and attaching a distal end of the second vertical member to the other front leg.

These and other features of the present invention will become apparent upon review of the following detailed description of the preferred embodiments when taken in conjunction with the drawings and the appended claims.

DETAILED DESCRIPTION OF EXEMPLARY EMBODIMENTS

Figure 1A:
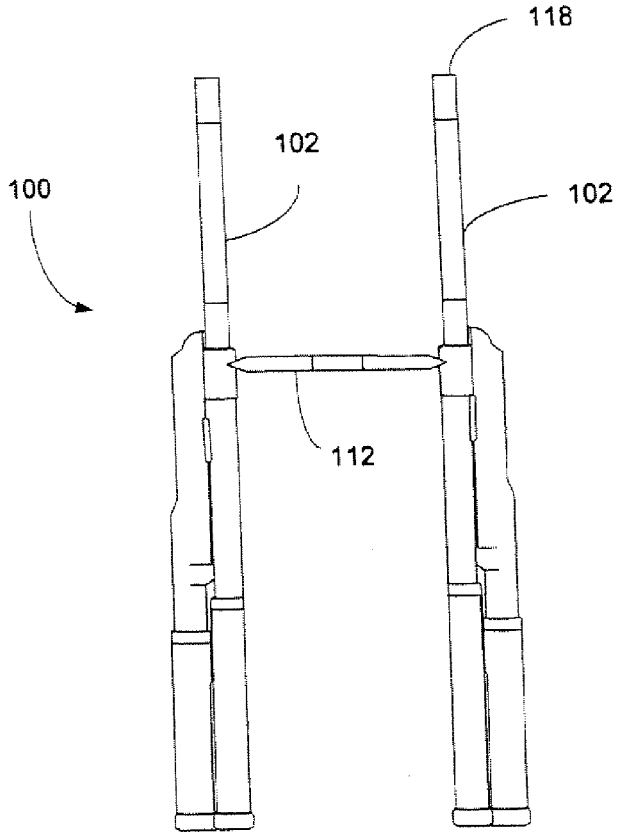
FIGS. 1A-1C demonstrate several views of an embodiment in accordance with the present invention.
Figure 1B:
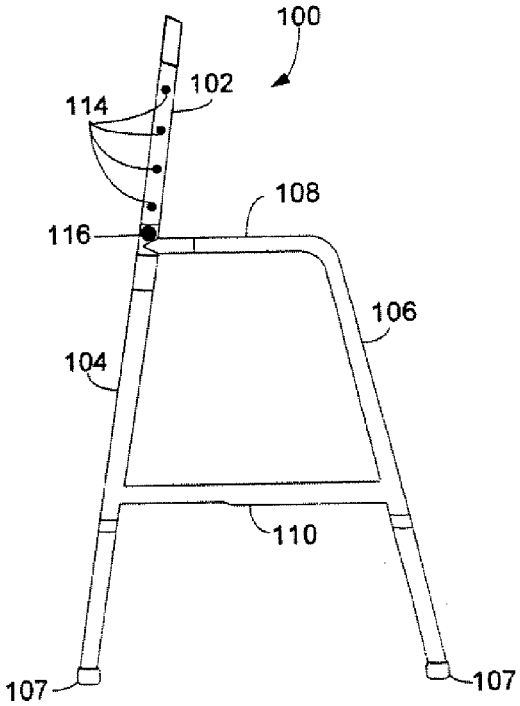

Referring now to the figures, where the various numbers represent like parts throughout the several views, FIG. 1A demonstrates a walker device according to an embodiment of the present invention, including a walker 100 with one or more lifting arms 102. The walker 100 may be any type of walker device known in the art, which generally are used by persons who need support, assistance or stabilization to walk. These devices may be used by the elderly, persons recovering from sickness or surgical procedures, persons with balance problems, or other conditions. As illustrated in FIG. 1B, the walker 100 may include a pair of front legs 104 and a pair of back legs 106. Each leg 104/106 may be fitted with a shoe 107, which may be made from rubber or other tacky material and may aid in preventing slips. The front leg 104 and the back leg 106 on each side of the walker 100 may be connected by one or more support members, which, as shown in FIG. 1B, may include a top support 108 and a bottom support 110. The top support often functions as a handle when the walker 100 is in use. The two front legs 104 of the walker 100 may be connected by support members, which, as shown in FIG. 1A, may include a cross support 112. The support members, such as the cross support 112, may be configured in a manner different than that illustrated in FIG. 1A. For example, alternatively, two support members may be connected as intersecting diagonal members respective to the two front legs 104, or two or more support members may be connected in parallel orientation between the two front legs 104. Those of ordinary skill in the art will recognize that other configurations for the walker 100 are possible, and the description of the walker 100 herein is exemplary only.

Figure 13:
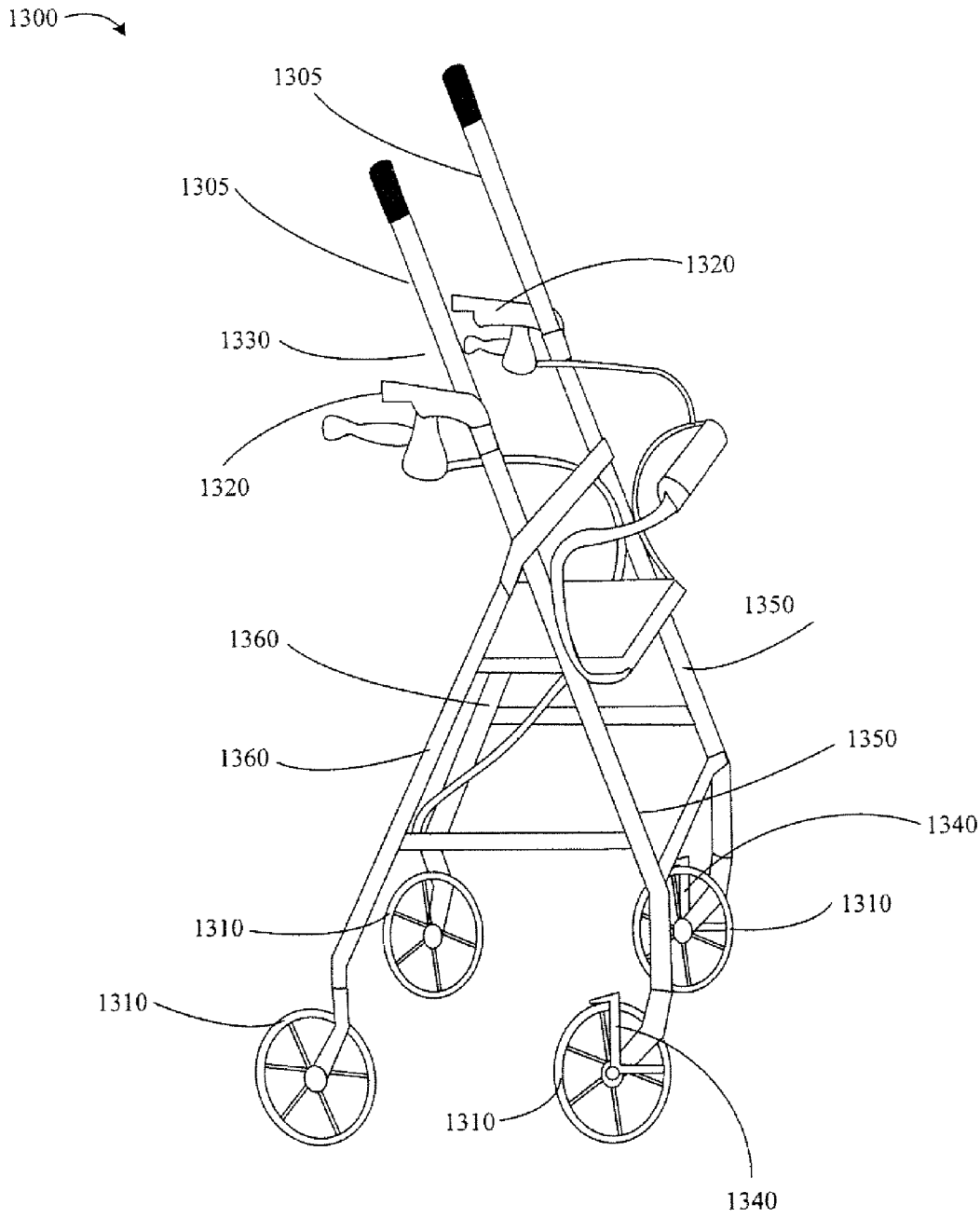
FIG. 13 demonstrates an embodiment of a wheeled mobility device in accordance with the present invention.

Further example embodiments of a walker device having at least one or more lifting arms are given herein. For example, one or more lifting arms may be attached to a rollator as illustrated in FIG. 13 and described below. Another walker device with which one or more lifting arms may be integrated may be a wheeled walker, as is known in the art, illustrated in FIG. 14, and described below. Other walker devices known may be recent variations on the typical walker as described above and illustrated in FIGS. 1A and 1B and may also include one or more lifting arms configured as described in other embodiments. Additionally, a lifting arm may be integrated with a multiple-legged cane having three or more legs as support points, as is known and illustrated in FIG. 15. In an additional embodiment, one or more lifting arms may be integrated with a wheeled mobility device. A wheeled mobility device may be a wheelchair, a scooter, or the like, as illustrated in FIGS. 16A and 16B.

It should be appreciated that the foregoing descriptions of various walker devices are meant as illustrated examples only, and that one or more lifting arms 102 may be attached to any walker device or walking aid as described herein or as are known in the art; however, for simplicity, the walker 100 when described herein is used as an example walker device.

The various members of the walker 100 may be formed of 1 inch diameter, 0.0125 inch wall thickness aluminum tubing, which is known in the art and common for such applications. Other equivalent or similar materials may be used and other sizes may be possible. For example, the members of the walker 100 may be formed from a fiberglass material or from a plastic or other polymer material. The members may be attached pursuant to methods known in the art.

The lifting arms 102 may also be formed of tubular aluminum or other similar materials, as described above or as are known in the art. The diameter of the lifting arms 102 may be sized such that the lifting arms 102 may be telescopically mounted into one or more of the legs 104/106 of the walker 100. As shown in FIG. 1B, the lifting arms 102 may be mounted in the front legs 104 of the walker 100, though, in other embodiments of the walker 100, it may be beneficial to mount the lifting arms 102 in the rear legs 106. The telescopic mounting of the lifting arms 102 may allow the lifting arms 102 to extend from the front legs 104 in an upward or approximate vertical direction. Further, the telescopic mounting of the lifting arms 102 may allow for the efficient adjustment of the height of the lifting arms 102, as the lifting arms 102 may be slid upward to an extended position (as shown in FIG. 1C) or downward to a non-extended position (as shown in FIG. 2A) or positions in between, as desired.

Figure 1C:
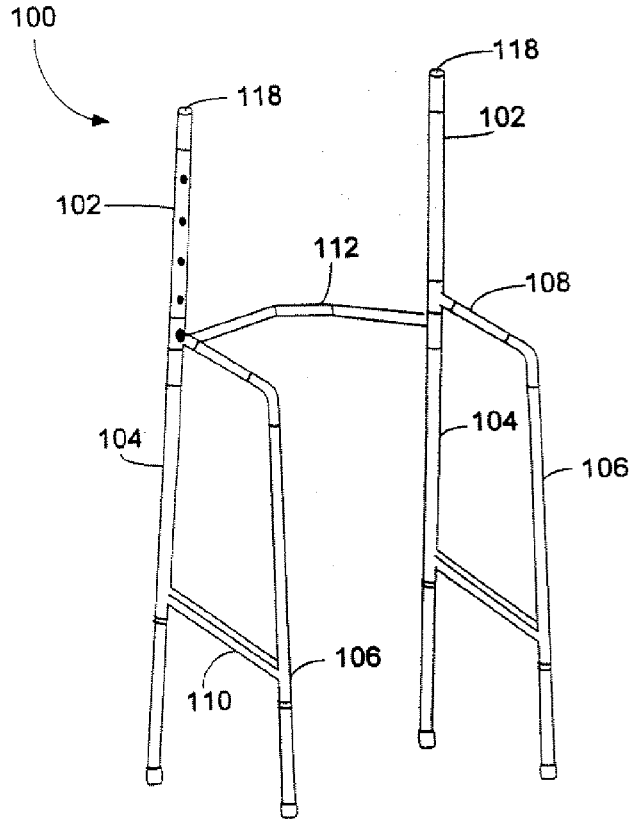
Figure 2A:
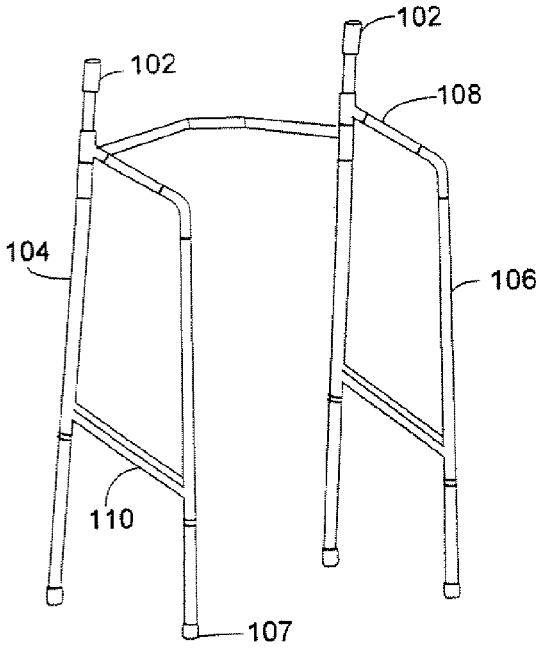
FIGS. 2A-2C demonstrate several additional views of the embodiment of FIG. 1.
Figure 2B:
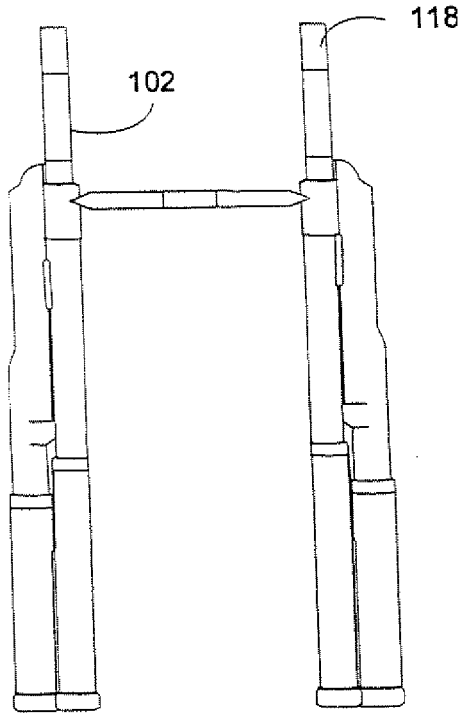
Figure 2C:
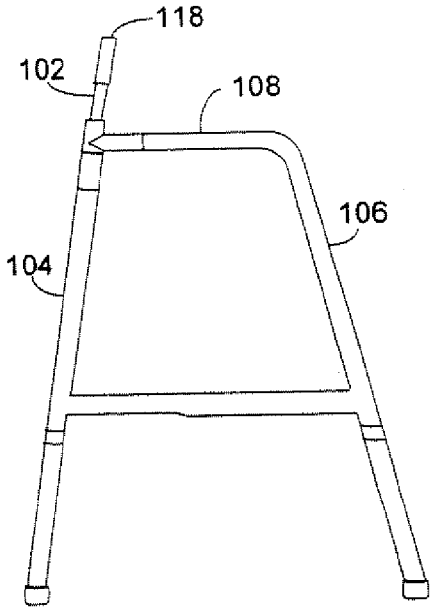

With regard to the embodiment illustrated in FIG. 1C, the lifting arms 102 may engage the front legs 104 such that, when desired, the lifting arm 102 becomes fixed at certain positions of extension. As stated, the positions of extension may include an extended position, non-extended position, and/or other intermediate extended positions. This adjustable function may be accomplished by using any of several common mechanical systems known in the art. One such system may include a series of openings 114 that are engaged by a pin 116. In some embodiments, the openings 114 may be spaced along the lifting arms 102 such that their placement coincides with the desired positions of extension for the lifting arm 102. The pin 116 may be located in the upper portion of the front leg 104. In a closed state, the pin 116 may engage the opening 114 of the lifting arm 102, thus securing the lifting arm 102 in a fixed position. In an opened state, the pin 116 may disengage from the opening 114 and allow the lifting arm 102 to telescopically slide to other positions of extension.

Figure 21:
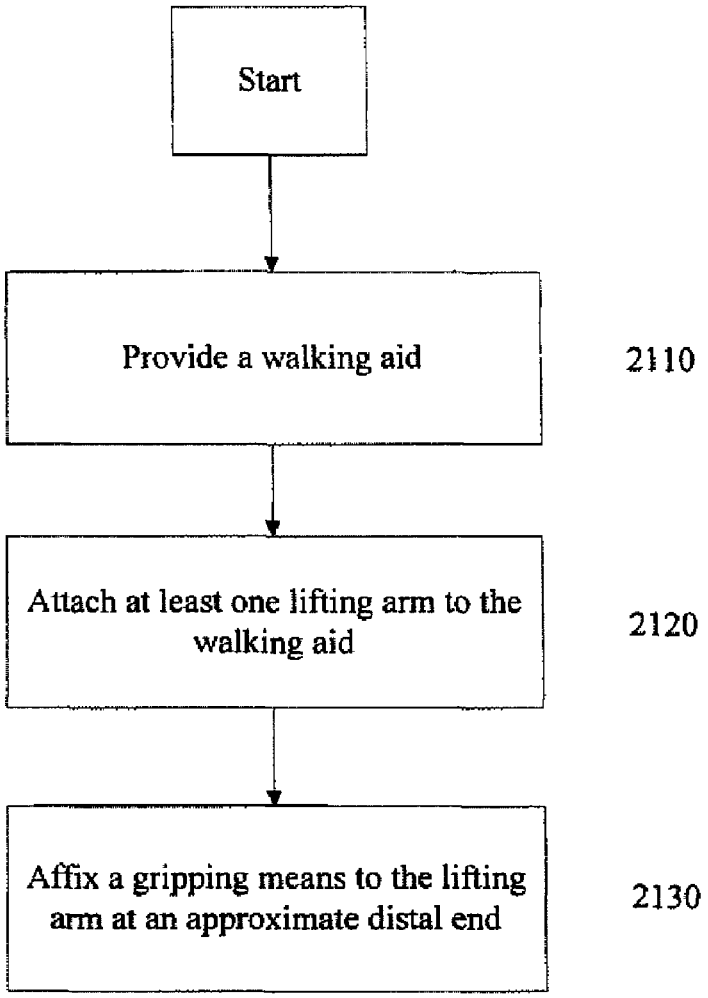
FIG. 21 demonstrates an example method of manufacturing a walker device in accordance with the present invention.

As stated, one of the openings 114 may be located on the lifting arm 102 such that it coincides with an extended position. In the extended position, the lifting arm 102 may fully extend such that much of the length of the lifting arm 102 extends in an approximate vertical direction above the front leg 104. In this position, as shown in FIG. 1C, the lifting arm 102 may be extended above the top of the front leg 104 a length of about 12 to 36 inches, preferably at least 12 to 24 inches, providing sufficient separation between the helper's hand and the seated person's hand, so as to cause sufficient leverage when acted on by the helper. Another opening 114 may be located on the lifting arm 102 such that it coincides with a non-extended position. In this position, much of the length of the lifting arm 102 may be contained within the front leg 104, as shown in FIG. 2A. The lifting arm 102 may include a gripping handle 118 positioned approximately at its distal end. In the non-extended position, only the gripping handle 118 and/or a small portion of the lifting arm 102 may extend above the top of the front leg 104. In other embodiments, though, the complete lifting arm 102, including the gripping handle, may be contained in the front legs in the non-extended position, such as is illustrated in FIG. 21. In addition, in other embodiments, the lifting arm 102 may be provided in a fixed position (i.e., non-adjustable position) relative to the walker 100. In yet other embodiments, one or more lifting arms 102 may be attached in a hinged manner to the walker device, for example at either the top of the front or rear legs, though they may be attached to any point on the walker device, and may pivot both toward the patient and toward the helper when in use, such as is illustrated in FIGS. 5B-5C and FIGS. 17A-17B.

Figure 20A:
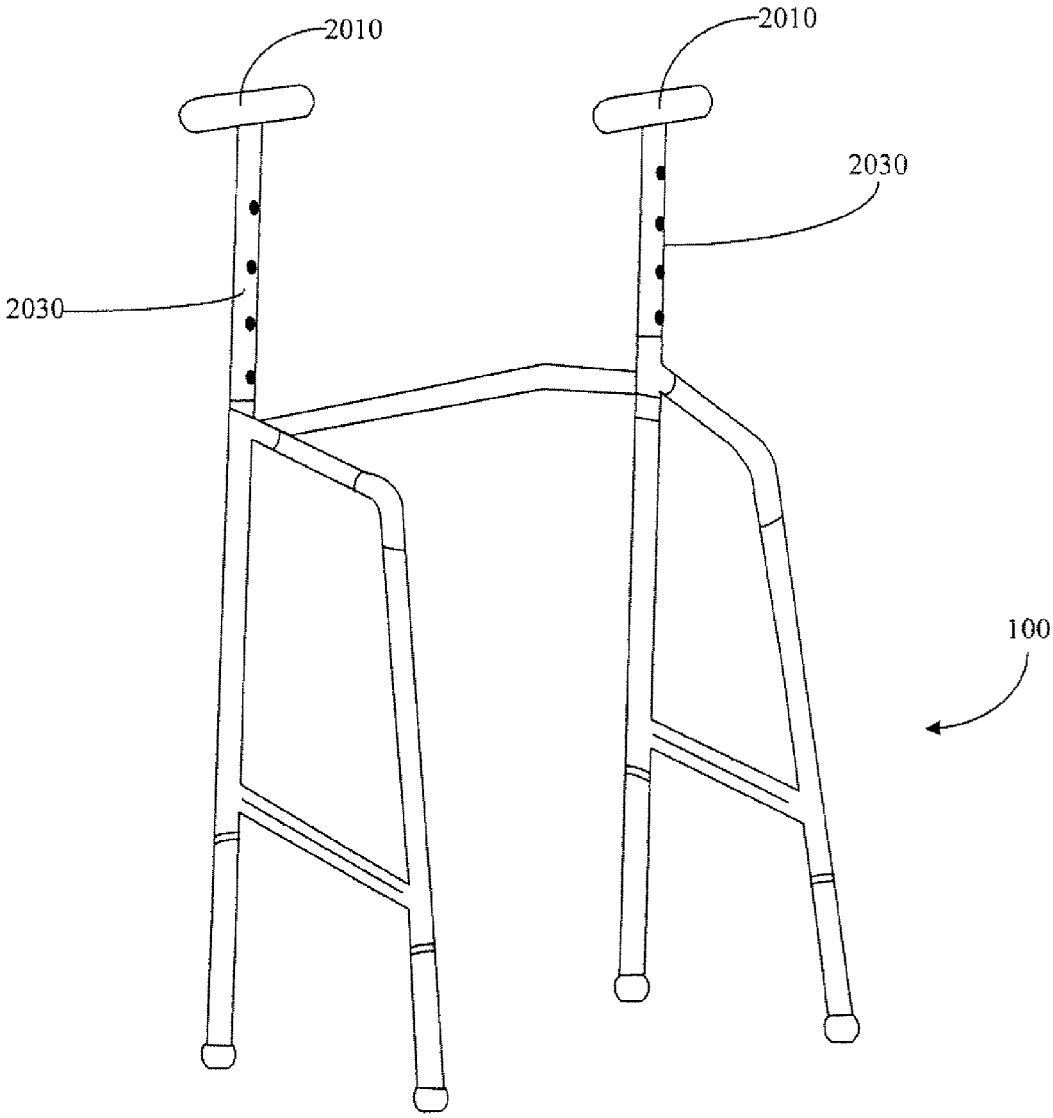
FIGS. 20A-20C demonstrate several views of embodiments of a walker device that includes a gripping handle in accordance with the present invention.
Figure 20B:
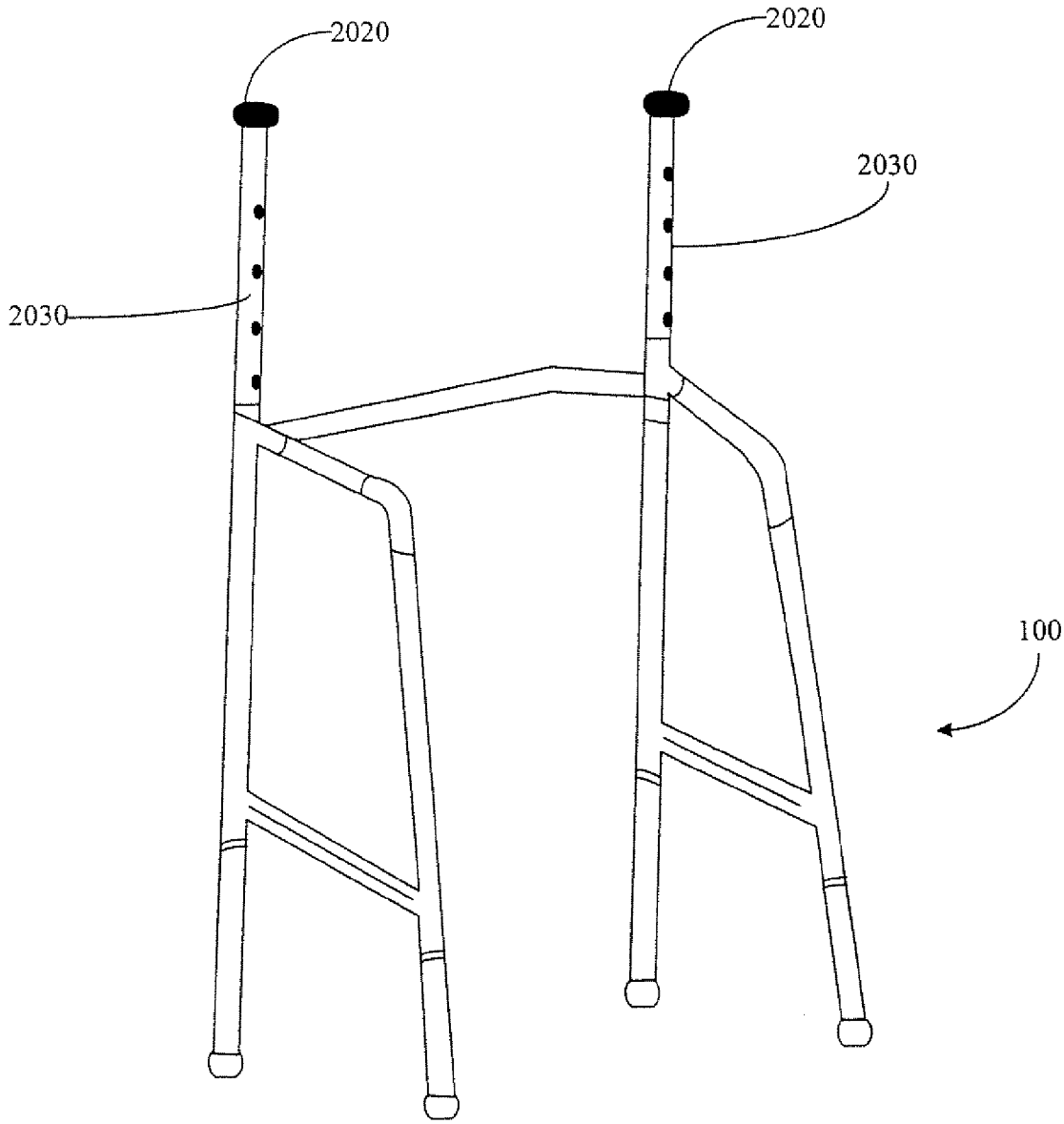
Figure 20C:
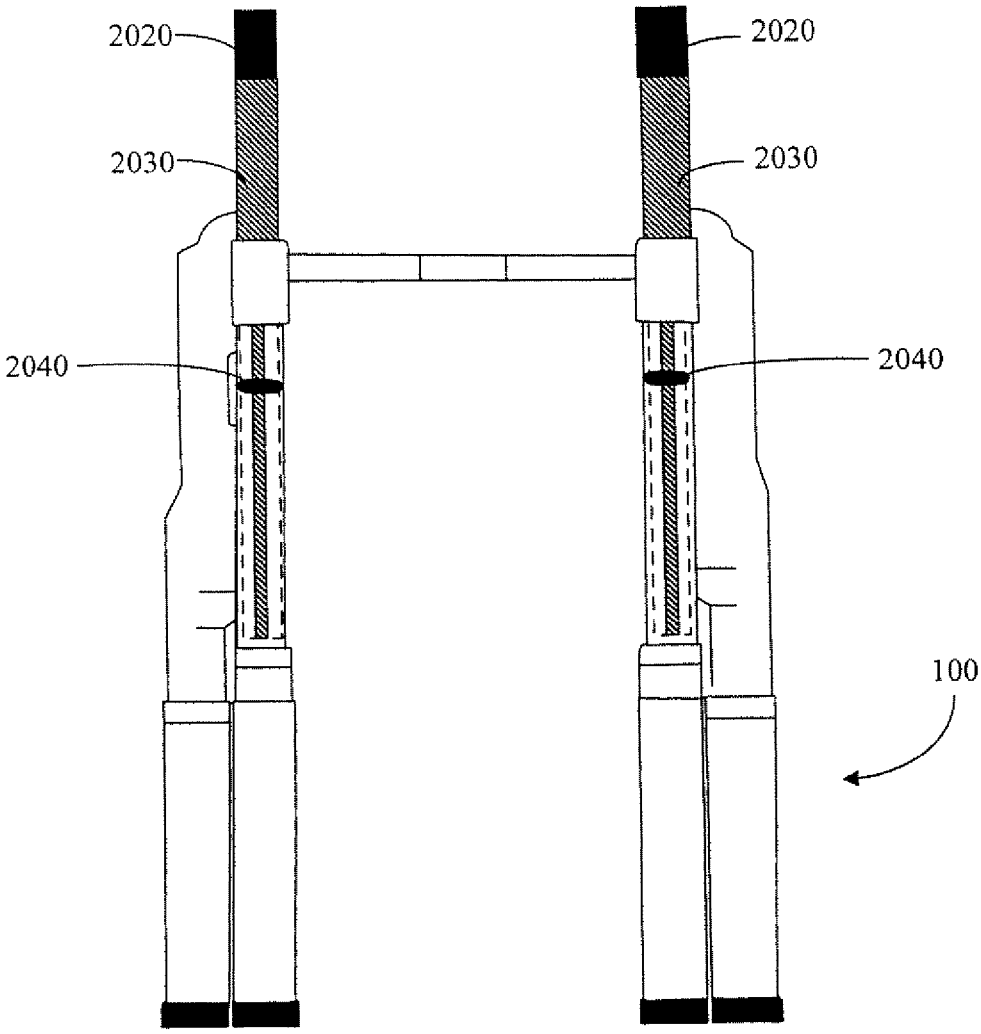

The gripping handle 118 may be configured as any gripping handle as is known in the art. The gripping handle 118 may be configured in an orientation aligning with the axis of the lifting arm 102 or in an radial orientation perpendicular to the axis of the lifting arm 102. In one example embodiment, the gripping handle 118 may be approximately 4 to 5 inches in length; may be made of foam, rubber, other polymers, or other similar materials that are commonly used for such applications; and may at least partially circumscribe the lifting arm 102. Alternative gripping handles may be constructed as an etched pattern, such as cross-hatching, in the surface of the lifting arm or a coarse coating on the surface of the lifting arm that creates a high-friction surface for gripping when in use, as is known in the art. In other embodiments, a gripping handle may be constructed by at least partially coating or wrapping the lifting arm 102 so as to at least partially circumscribe the approximate distal end of the lifting arm with a soft, pliable material to create a higher friction surface as well as a softer surface for gripping. Another alternative gripping handle 2010, as illustrated in FIGS. 20A and 20C, may include one or more handles that may be similarly coated, extending horizontally in an approximate perpendicular orientation to the axis of the lifting arm for comfortable gripping by the helper or configured to allow for more than one helper to grasp. A gripping handle 2020 may also be configured as a knob or protrusion extending from the distal end of the lifting arm as illustrated in FIG. 20B. A second gripping handle 1720 may be included on the lifting arm 102 positioned at a point below the first gripping handle and configured for gripping by the seated person in one or more of the embodiments described herein and illustrated in FIGS. 17A and 17B. Further, it is appreciated that a gripping handle may be any portion of the lifting arm that has the same diameter of the lifting arm and does not extend laterally, outward from the lifting arm, but is operable for gripping by the seated person or the helper. A gripping handle configured in this manner may be a gripping handle used in an embodiment of the lifting arm operating in a telescoping manner, like that described in reference to FIGS. 1B, 1C, 2A, and 21 for example. Additionally, a gripping handle and lifting arm configured in this manner may have a member, such as another handle or a knob, that extends outwardly from the lifting arm and through the legs into which the lifting arm retracts, such as is shown in FIG. 20B. This extra member may be used to grasp the lifting arm so as to allow extending it from the legs of the walker in an embodiment having lifting arms that fully or almost fully retract into the legs, leaving no portion exposed to grasp other than the member.

Figure 3:
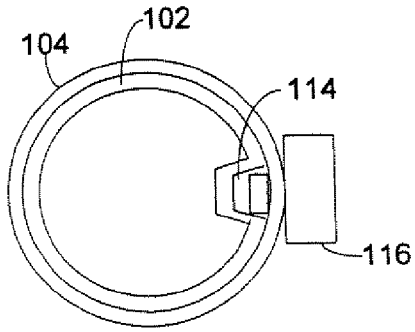
FIG. 3 demonstrates an embodiment of a pin/opening device that may be used in certain embodiments in accordance with the present invention.

FIG. 3 demonstrates an embodiment of the pin 116/opening 114 assembly that may be used with certain embodiments of the current invention to make the lifting arm 102 adjustable. To adjust the lifting arm 102, the pin 116 may be pulled outward such that it disengages the opening 114, which is referred to herein as the opened position. When the pin 116 is disengaged, the lifting arm 102 may be telescopically slid upward or downward, as appropriate, to a desired position of extension where an opening 114 that places the lifting arm at the desired position may be encountered. The pin 116 may be biased by a spring or other similar device such that it "clicks" into place when it encounters another opening 114. Further, an alignment channel (not shown) may be used to engage the pin 116 while adjustment is being performed such that the openings 114 remained aligned with the pin 116 location. In such an embodiment, the pin 116 may disengage from the opening 114 of the lifting arm 102 while remaining engaged with an alignment channel formed in the surface of the lifting arm 102. The engagement of the pin 116 in the alignment channel would guide the lifting arm 102 during adjustment so that the pin 116 and the openings 114 remained longitudinally aligned. Those of ordinary skill will recognize that other methods and systems are available for adjustably connecting the lifting arms 102 to the front legs 104. The pin 116/opening 114 assembly is provided herein as an example only. Other known methods, such as a releasable clamp, removable bolt or other suitable method may be used.

Figure 4B:
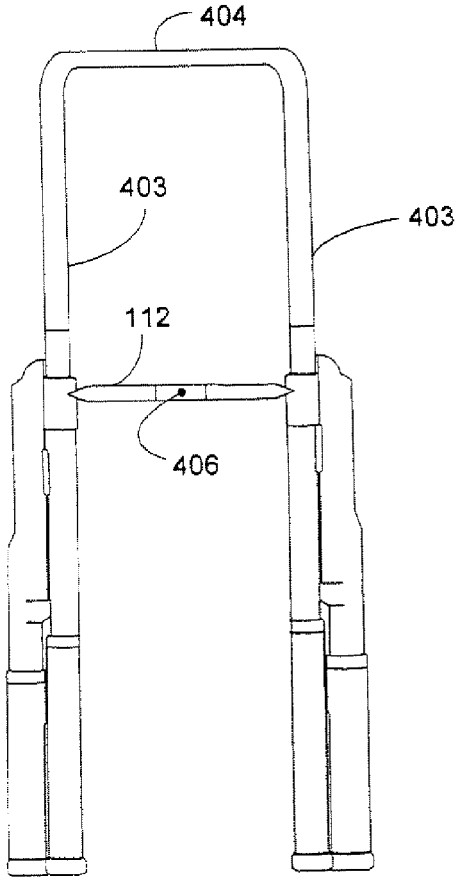
FIGS. 4A-4C demonstrate several views of an alternative embodiment in accordance with the present invention.
Figure 4A:
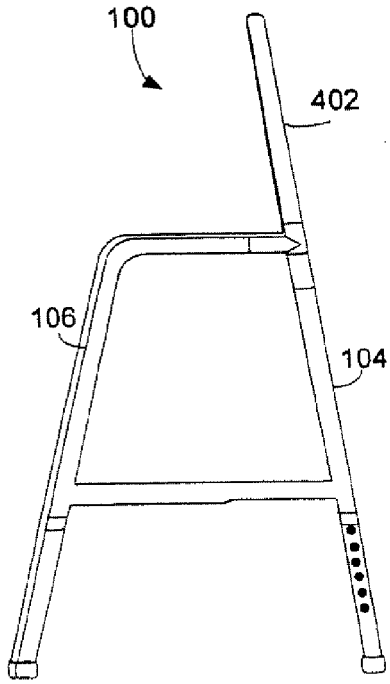
Figure 4C:
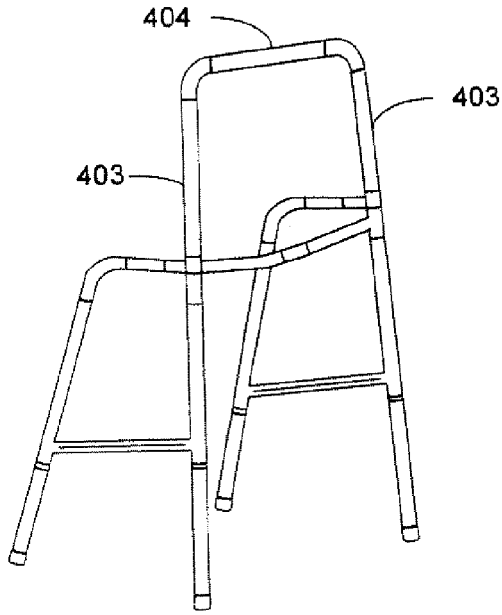

FIG. 4 demonstrates another embodiment in accordance with the present invention, including the walker 100 with a lifting arm 402. Generally, the walker 100 may be as it is described above; though, those of ordinary skill will appreciate that other types of walkers may be used with the lifting arm 402 embodiment. As shown in FIG. 4, the lifting arm 402 may be mounted in the front legs 104 of the walker 100, though, in other walker embodiments, it may be beneficial to mount the lifting arm 402 in the rear legs 106. Lifting arm 402 may include a vertical member 403 that extends in an approximate vertical direction from each of the front legs 104. The two vertical members 403 may then be connected by a horizontal connector 404.

Each of the vertical members 403 of the lifting arm 402 may extend telescopically out of the front legs 104, similar to the manner in which it was explained above that the lifting arms 102 extended out of the front legs 104. A similar pin 116/opening 114 assembly may be used to allow the lifting arm 402 to be adjusted and fixed at certain positions of extension. As shown in FIG. 4, the lifting arm 402 may be adjusted to an extended position, in which the horizontal connector 404 resides approximately 12 to 36 inches above the top of the front legs 104. In the extended position, the lifting arm 402 may fully extend such that much of the length of the vertical members 403 extends above the front legs 104. In a non-extended position (not shown), much of the length of the vertical members 403 may reside inside the front legs 104. In this position of extension, the horizontal connector 404 may reside in close proximity to the cross support 112 of the walker 100. Additionally, a gripping handle may be included at one or more points on the horizontal connector 404 for the helper to grasp, or, alternatively, the horizontal connector 404 may be considered the gripping handle and be operable for the helper or the seated person to grasp.

The one piece construction of the lifting arm 402 may allow for more efficient and convenient adjustment. For example, in certain embodiments, a single adjustment actuator 406, may disengage both pins 116 associated with each of the vertical members 403 with a single action. The single adjustment actuator may be located on the cross support 112. A connection from the single adjustment actuator 406 may be made through the tubular cross support 112 to the location of the pins 116, which may be located at the intersection of the front legs 104 and the cross support 112. The single adjustment actuator 406 and the connections made through the cross support 112 to the pins 116 may be made with systems and devices known in the art. With the single adjustment actuator 406, the lifting arm 402 may be released from a fixed position, raised in a single action, i.e., one hand may depress the single adjustment actuator 406, which disengages both pins 116 of the vertical members 403 and, in turn, allows the lifting arm 402 to slide telescopically within the front legs 104, while the other hand raises or lowers the lifting arm 402 to the desired position of extension. In other embodiments, an adjustment actuator may be located on each of the front legs 104 that separately disengages the pin 116 associated with each vertical member 403. In still other embodiments, a single adjustment actuator may be located on other components of the walker 100, such as on one of the front legs 104 or one of the top supports 108.

Figure 5A:
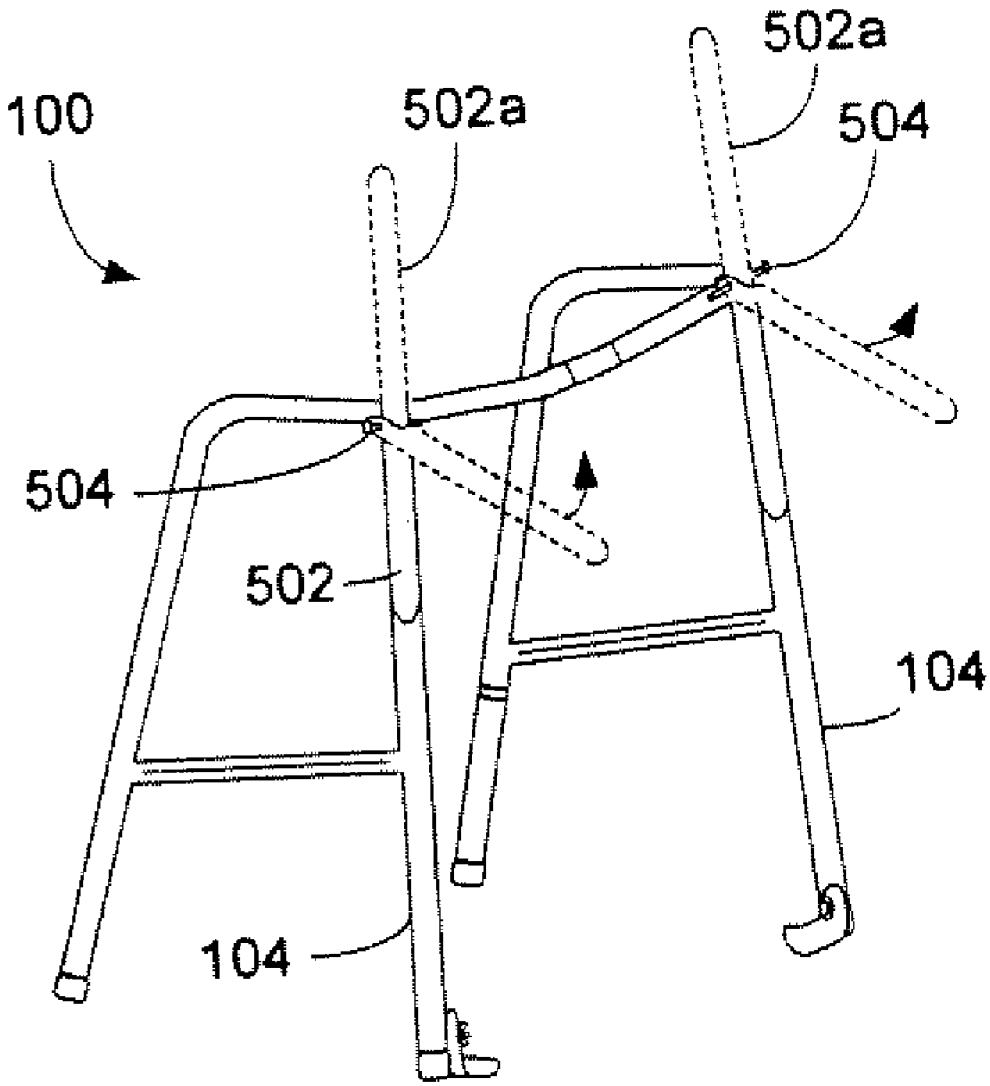
FIGS. 5A-5D demonstrate several views of an alternative embodiment in accordance with the present invention.

FIG. 5A demonstrates another embodiment in accordance with the present invention, including the walker 100 with lifting arm 502. In this embodiment, the lifting arm 502 may be hinged to a position on the front leg 104 of the walker 100. While not in use, the lifting arm 502 may reside in a "down" position such that it is adjacent to the front leg 104. The lifting arm 502 may be concave in shape so that it may rest closely to the rounded surface of the front leg 104. The lifting arm 502 may be rotated upward (as indicated by the arrows) about a pivot point 504. The pivot point 504 generally may be located between the midpoint and top of the front leg 104. The hinged connection may be constructed by methods and devices known in the art, such as pinning the lifting arm 502 to the front legs 104 or other similar methods. The lifting arm 502 may rotated approximately 180° about the pivot point 504 to an "up" position, which is indicated by dashed lines as lifting arm 502*a*. In the "up" position the lifting arm 502*a* may lock into position so that it may be used. The lifting arm 502 then may unlock so that it may be rotated back to the "down" position when not in use. The locking/unlocking function may be accomplished per methods known in the art.

Figure 5B:
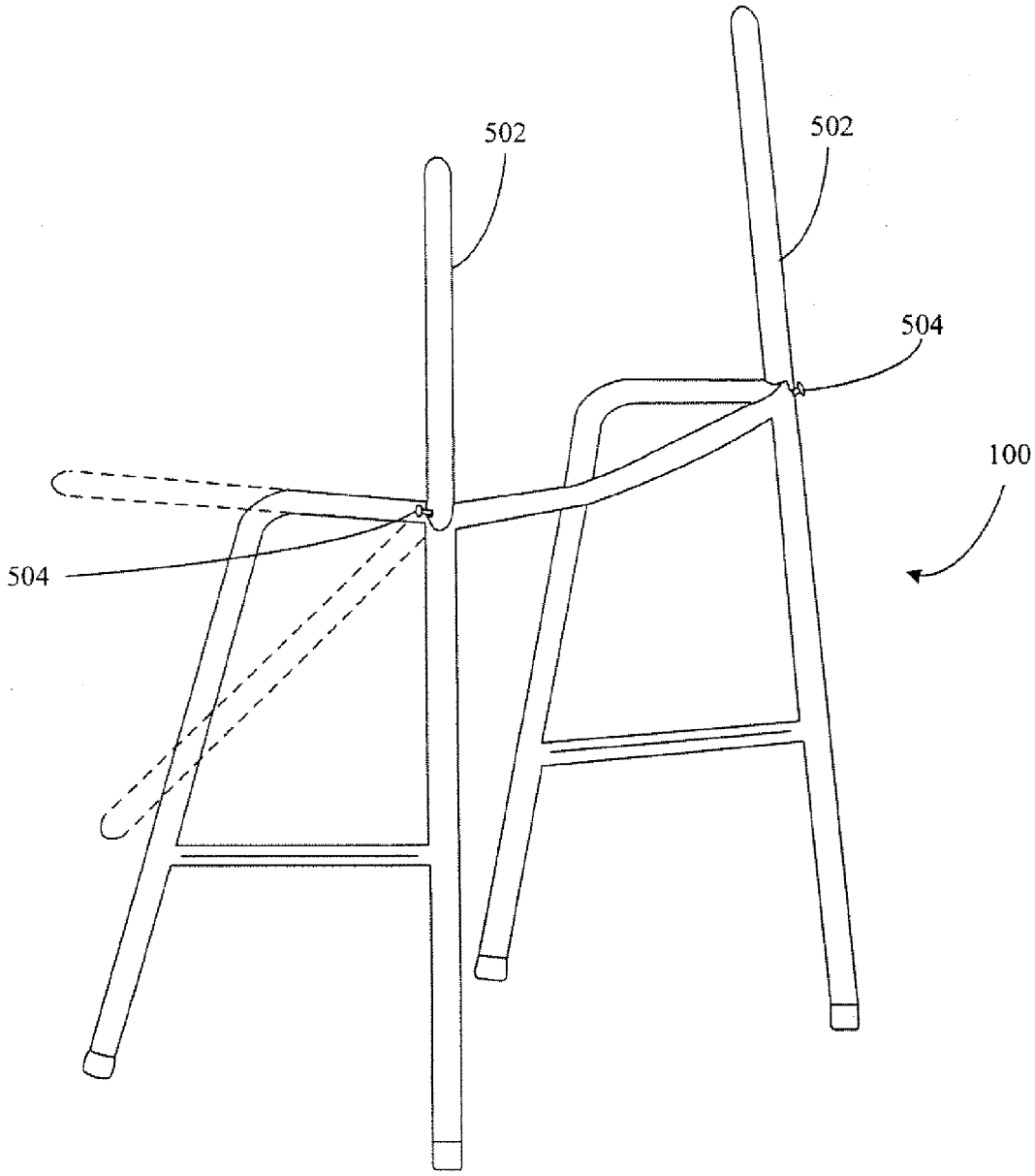

Alternatively, as is illustrated in FIG. 5B, the lifting arm 502 and pivot point 504 may be configured so the lifting arm 502 also (or in alternative embodiments only), pivots back toward the user, such that when it is not in use and in a "down" position, it is substantially parallel to the horizontal top support 108 (described in reference to FIG. 1B). In one alternative embodiment, the lifting arm 502 configured to also pivot back toward the user may include a ratcheting mechanism in the pivot or hinge to stop the pivoting in the direction toward the seated person after passing one or more points. For example, the pivot or hinge may include one or more stops. After extending the lifting arm 502 to the seated person, and the helper pulls toward himself/herself and away from the seated person, each time the lifting arm passes a stop, the lifting arm could not be pivoted back beyond the stop and toward the seated person without disengaging the ratcheting mechanism. However, the ratcheting mechanism would be configured to move freely in the direction toward the helper while pulling the seated person to a standing position. A ratcheting mechanism configured in this manner is helpful to prevent seated persons from falling back to their seats or to the ground if the helpers lose their grip or let go of the lifting arm 502.

Figure 5C:
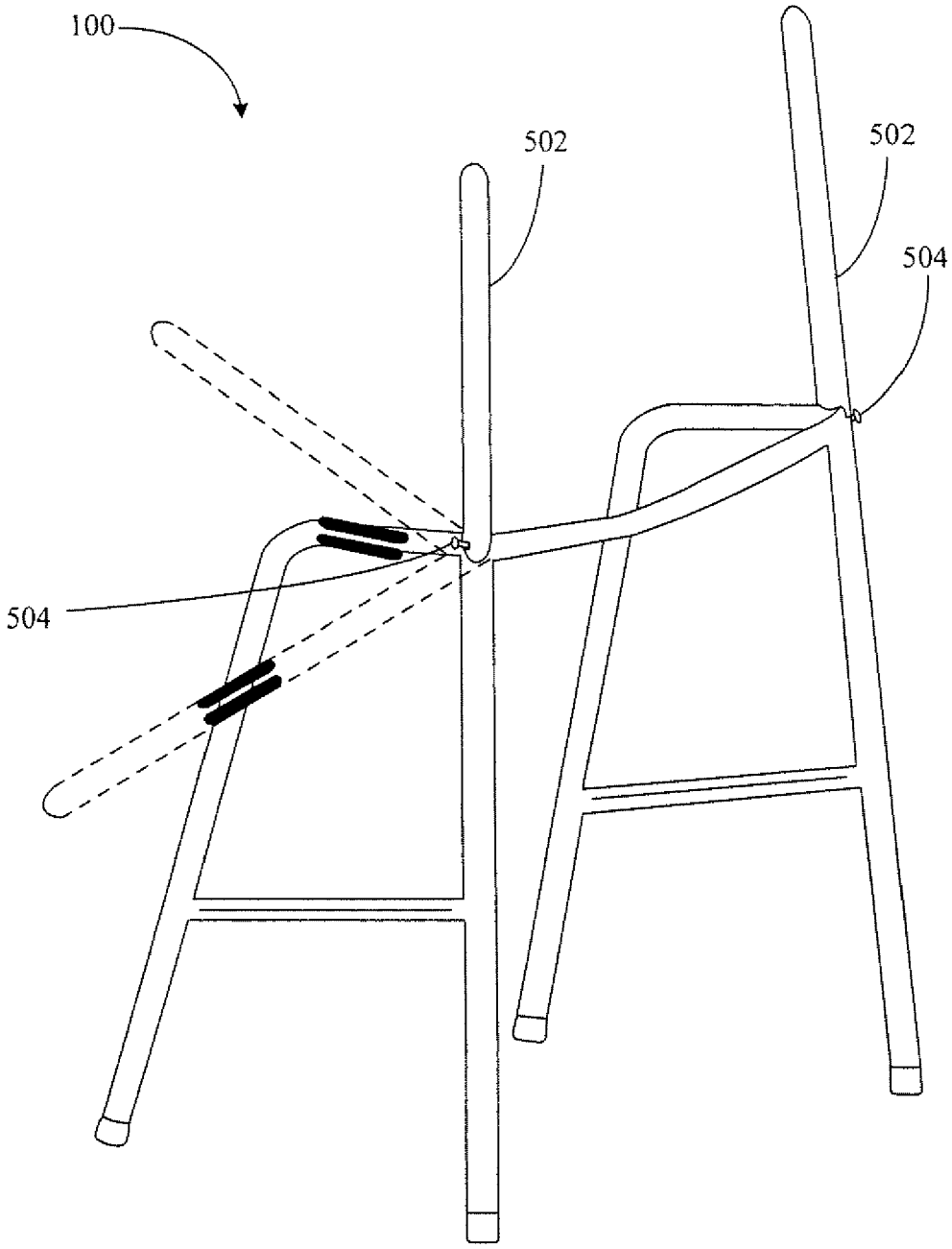

To prevent interference with the walker's handles/grips, the lifting arm 502 may either attach at the sides of the top supports 108 or may rotate beyond the top supports 108 so as to rest in the "down" position at an approximate diagonal position with the distal end of the lifting arm resting lower than the top support member, as illustrated in FIG. 5C. The lifting arm 502 may be secured in the "down" position by one or more attaching means 510 positioned at one or more points on the walker, for example on the back legs 106 or the bottom support 110, or positioned on the lifting arm 502. The attaching means 510 may be c-shaped clamping mechanisms that engage and partially surround the lifting arm 502 or a support member, on the walker, as illustrated in FIG. 51. The attaching means configured like that illustrated in FIG. 5D may alternatively be affixed to the lifting arm and engage a support member of the walker. Alternatively, the attaching means 510 may be Velcro, a slot configured to receive a bracket, a clip, or the like, as is known in the art.

Figure 5D:
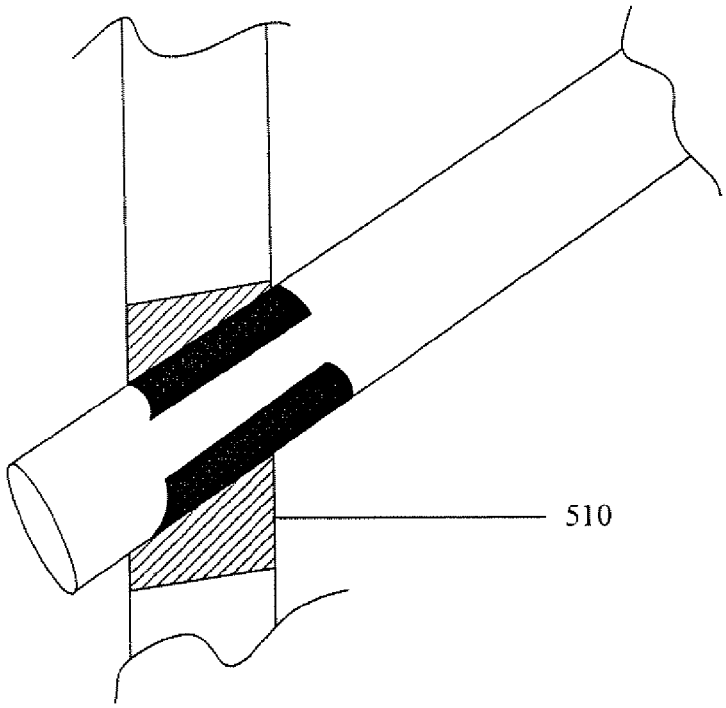
Figure 6:
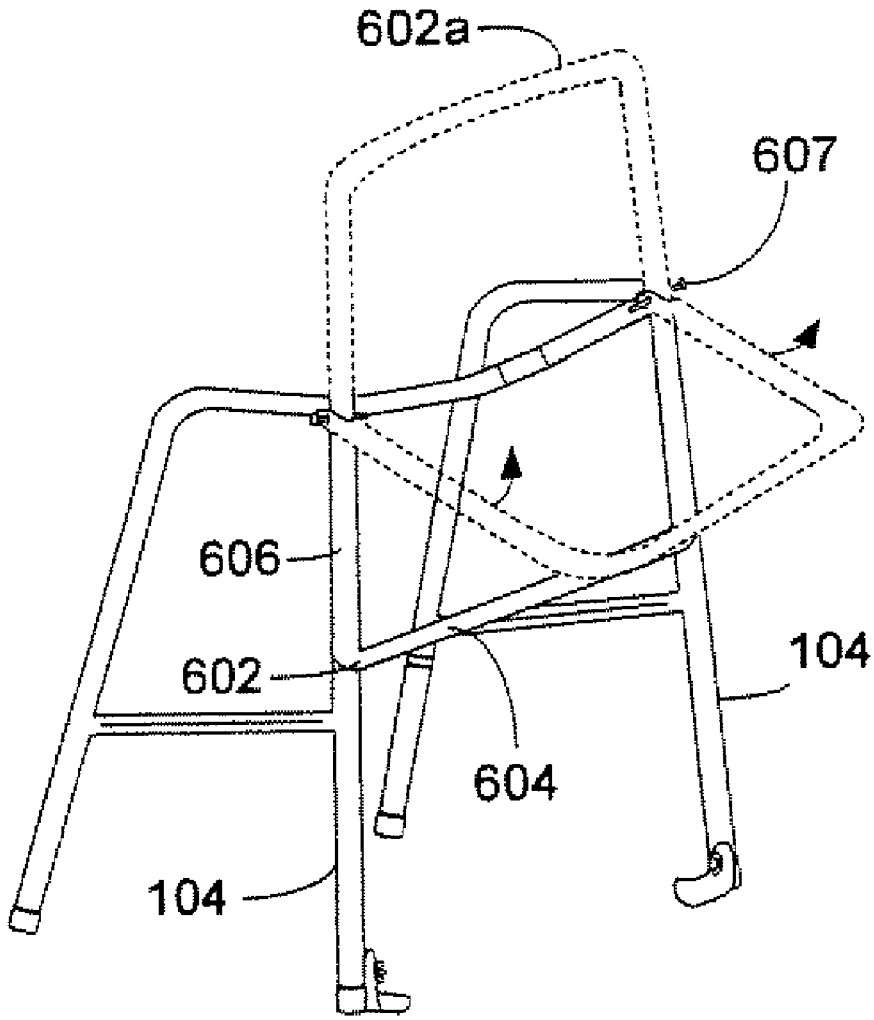
FIG. 6 demonstrates a view of an embodiment in accordance with the present invention.

FIG. 6 demonstrates another embodiment in accordance with the present invention, including the walker 100 with a lifting arm 602. In this embodiment, the lifting arm 602 may include a horizontal connector 604 that connects two vertical members 606. Similar to the embodiment discussed above, the vertical members 606 of the lifting arm 602 may be hinged to a position on the front legs 104 of the walker 100. While not in use, the lifting arm 602 may reside in a "down" position such that the vertical members 606 are adjacent to the front leg 104. The lifting arm 602 may be rotated upward (as indicated by the arrows) about a pivot point 607. The pivot point 607 generally may be located between the midpoint and top of each of the front legs 104. The hinged connection may be constructed by methods and devices known in the art, such as pinning the vertical members 606 to the front legs 104 or other similar methods. The lifting arm 602 may be rotated approximately 180° to an "up" position, which is indicated by dashed lines as lifting arm 602*a*. In the "up" position the lifting arm 602*a* may lock into position so that it may be used. The lifting arm 602 then may unlock so that it may be rotated back to the "down" position when not in use. The locking/unlocking function may be accomplished per methods known in the art. Similarly, the lifting arm 602 may be secured in the "down" position by one or more attaching means 510 attached to the walker or the lifting arm at one or more points, for example at the front legs 104 or another horizontal cross-member connecting the two front legs, as described in reference to FIG. 5D above.

Figure 7A:
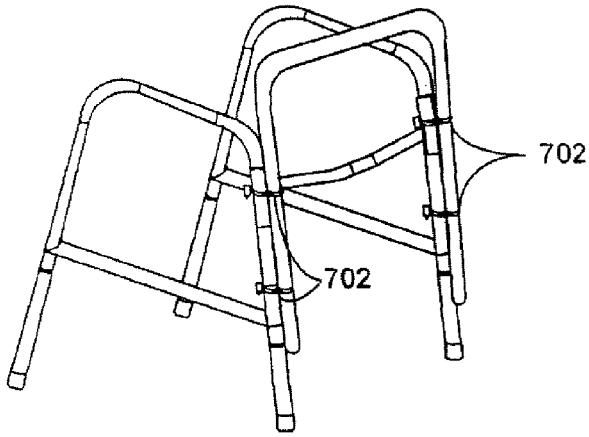
FIGS. 7A-7C demonstrate several views of an alternative embodiment in accordance with the present invention.
Figure 7B:
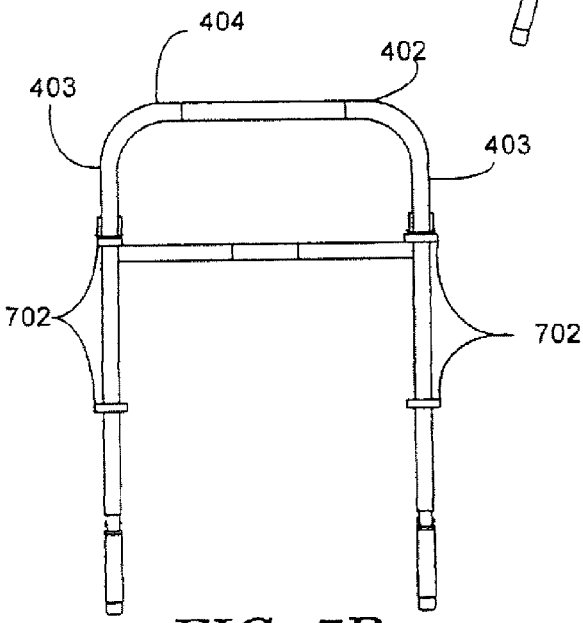
Figure 7C:
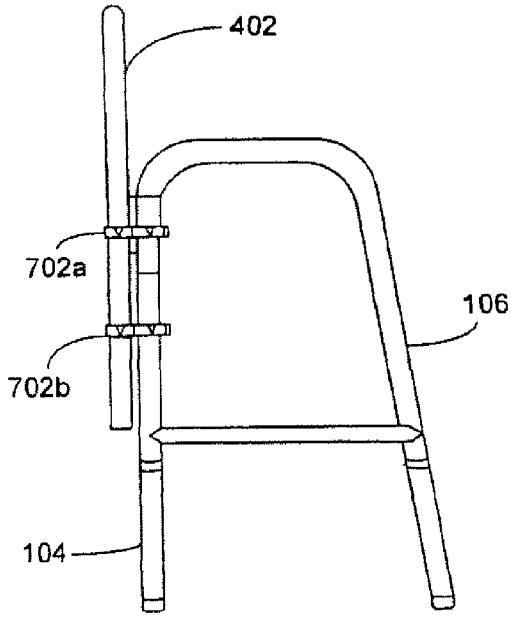

As demonstrated in FIG. 7, other embodiments of the current invention include attaching the lifting arm 402 onto each of the front legs 104 with one or more connectors 702. (Note that the other lifting arm embodiments described herein also may be attached to the walker 100 with the connectors 702, and the use in FIG. 7 of the lifting arm 402 is exemplary only.) In such embodiments, the lifting arm 402 no longer extends telescopically from the front leg(s) 104, but attaches to the outside thereof. The use of connectors 702 may allow for the efficient attachment of the lifting arm 402 to existing walkers. The connectors 702 may be any clamp or connector known in the art that may be used to attach two members side by side in the manner shown. For stability purposes, two or more connectors 702 may be used for each front leg 104/vertical member 403 pairing, such as an upper connector 702*a* and lower connector 702*b*, though those of ordinary skill in the art will recognize that different sized connectors may be used that would necessitate the use of only one connector 702 for each pairing.

Figure 8B:
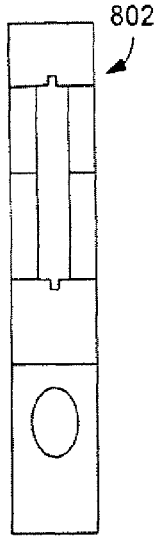
FIGS. 8A-8C demonstrate several views of an embodiment of a connector device that may be used in certain embodiments in accordance with the present invention.
Figure 8A:
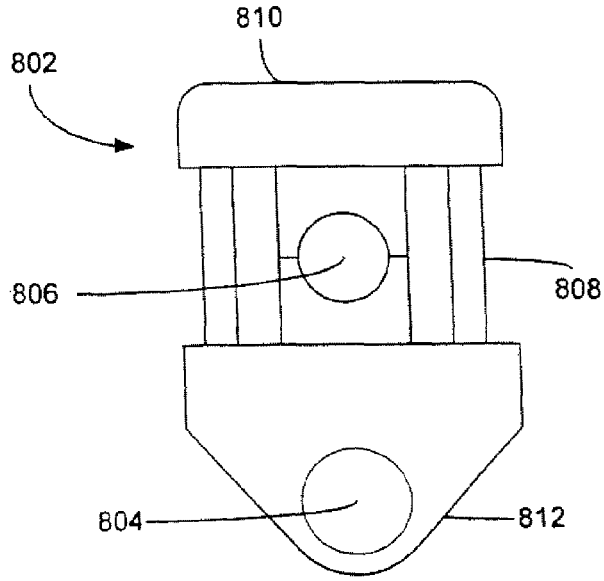
Figure 8C:
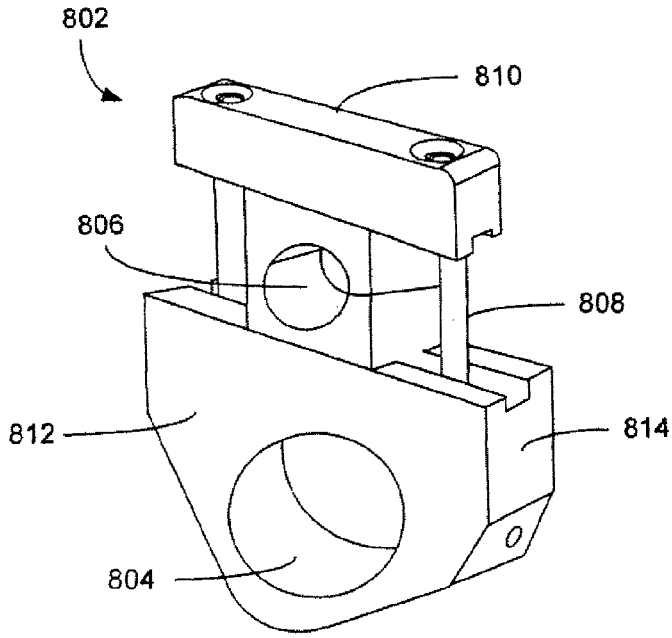

FIG. 8 demonstrates an embodiment of a connector that may be used in accordance with the present invention, a connector 802. The connector 802 may include a leg opening 804 that may be sized to fit around the front legs of a walker. The connector may include an arm opening 806 that may be sized to fit around the vertical member of a lifting arm. After the connector 802 is fitted in place (i.e., with the leg opening around the front leg and the arm opening around the vertical member), then two bolts 808 may be fed through an upper flange 810 positioned around the arm opening 806 and threaded into openings in a lower flange 812, which may be formed around the leg opening 804. The upper flange 810 may adjust laterally in relation to the lower flange 812 along channel 814. In this manner, the connector 802 may adjust to take into account the angle offset that may be present between the vertical member of the lifting arm and the front leg of some walkers. The bolts 808 may be tightened such that the connector 802 secures the lifting arm to the front leg. The lifting arm may be adjusted in its position relative to the front leg by loosening the bolts 808 and sliding the lifting arm relative to the front leg. In this manner, the lifting arm may be placed in an extended and non-extended position as desired. Those of ordinary skill in the art will recognize that other connectors may be used for this function and that the description herein is exemplary only.

The lifting arm using connectors like those described herein in reference to FIG. 7 or 8 may be removably attached to the walker. Either the walker or the lifting arm may include one or more attaching means 510, like that described in reference to FIG. 5D, to allow attaching the lifting arm when not attached to the walker. It should be appreciated that either one or more lifting arms 102, such as those described in reference to FIGS. 1A and 1C, or a lifting arm 402 having a horizontal connector 404, such as that described in reference to FIG. 4, may be removably attached using connectors.

Other means of connecting the lifting arm to walker 100 are possible. For example, in one embodiment (not shown), the lifting arm may be attached to a hinged connector that is clamped to the top of one of the front legs 104. Similar to the embodiment shown in FIG. 6, the hinged connector may be configured such that, when it is in a "down" position, the vertical members of the lifting arm may be in a position parallel and adjacent to the front leg. In this position, the lifting arm may be stored in a position that is not obtrusive to the functioning of the walker. The hinged connector further may be configured to rotate approximately 180° to an "up" position. When the hinge is in the "up" position, the lifting arm may extend in an approximate vertical direction above the front leg. Further, a lifting arm connected to the walker in a hinged manner, such as the lifting arm 502, 502*a* or the lifting arm 602*a*, may be used for grasping by both the helper and the seated person, by pivoting the lifting arm toward the seated person, then pivoting it away from the seated person toward the helper while the walker stays stationary. A lifting arm configured for use in this manner may be attached to the walker at any point from the lowest point to the highest point of the walker, creating a fulcrum about which the lifting arm pivots. Those of ordinary skill in the art will further recognize that other systems and devices may be used to attach the adjustable or fixed lifting arm of the present invention to an existing walker and that the embodiments that have been described herein are exemplary only.

Figure 9:
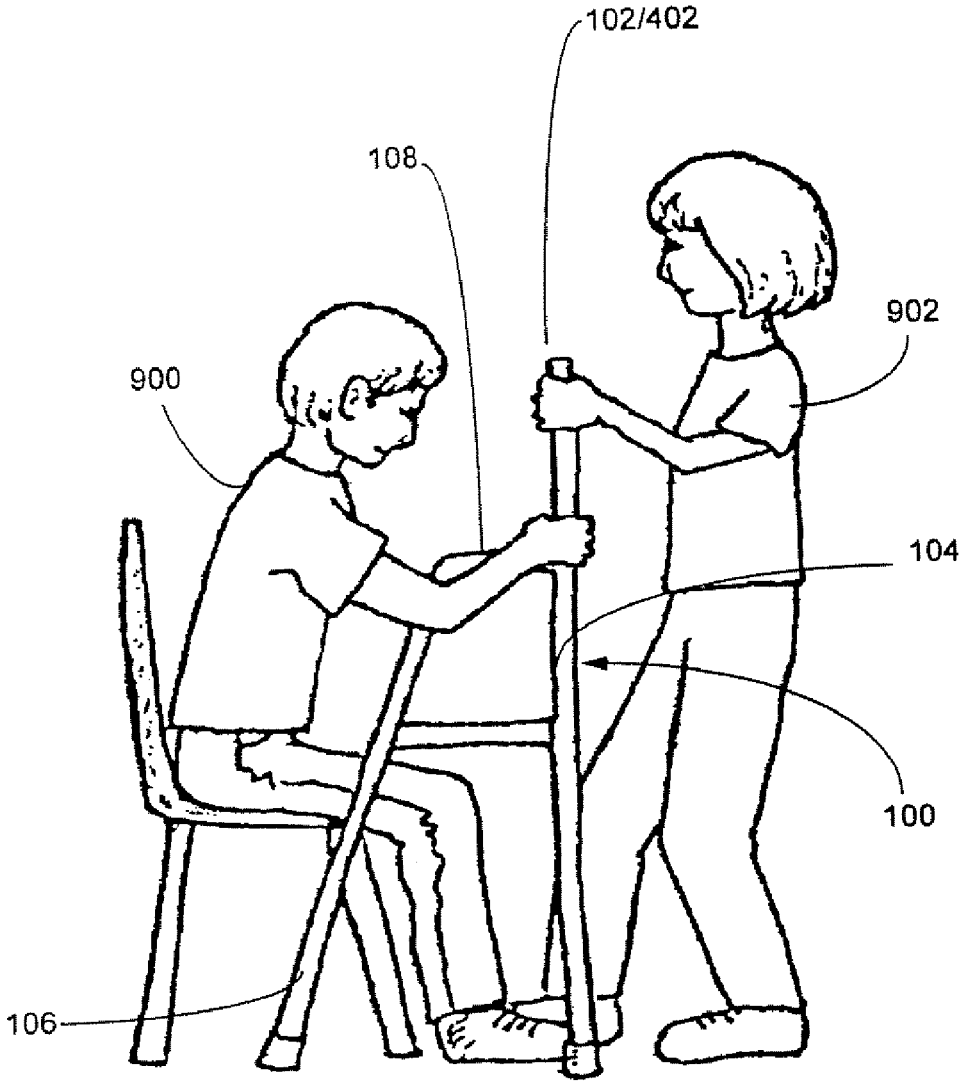
FIG. 9 demonstrates a view of an embodiment in accordance with the present invention in use.
Figure 10:
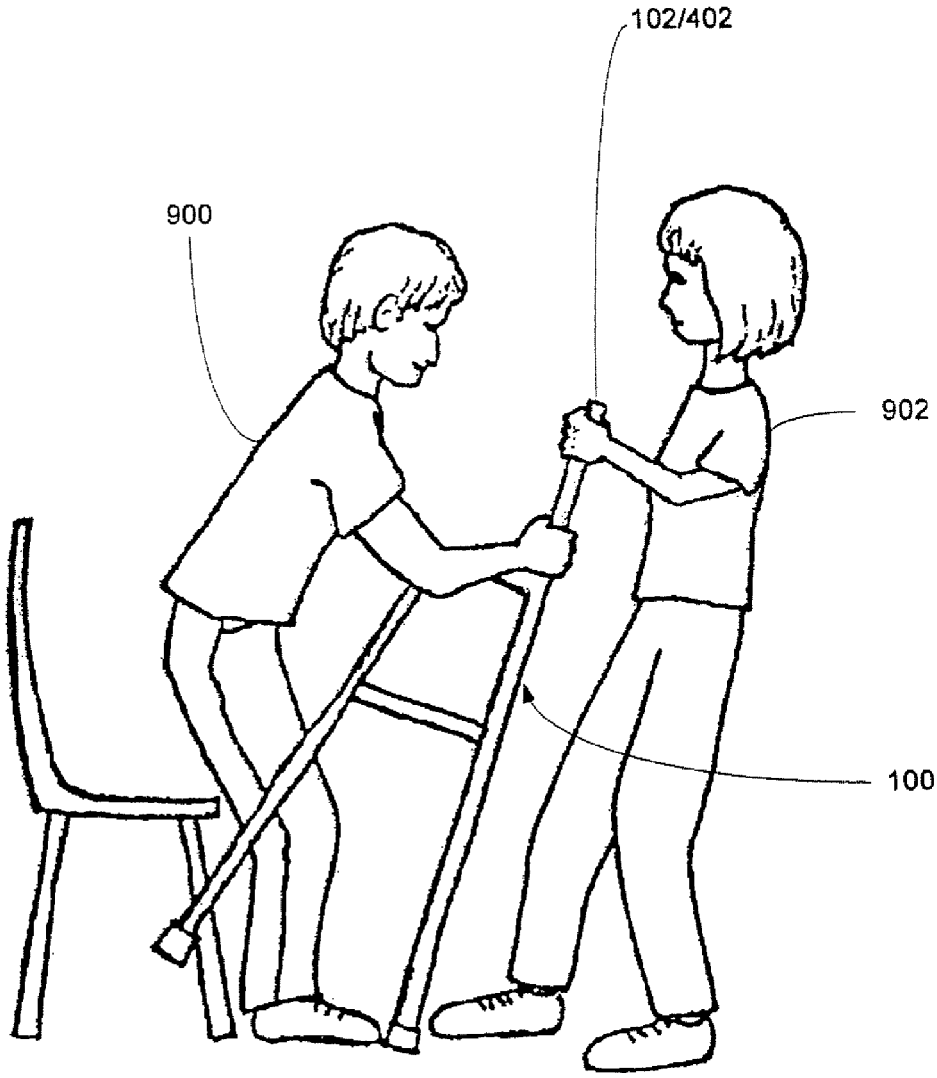
FIG. 10 demonstrates a view of an embodiment in accordance with the present invention in use.

In use, as shown in FIGS. 9 and 10, the lifting arm 402 may be used to assist a seated person 900 to stand. (Note that the use of lifting arm 402 in this example is exemplary only and that the other embodiments of lifting arms may be used in similar fashion.) As stated, the seated person 900 may be an elderly person, a person recovering from an illness or surgical procedure, or, in general, a person who has some mobility when standing (and may be able to use a walker) but has trouble standing from a seated position. The process of helping the seated person 900 to a standing position may begin by a helper 902 positioning the walker 100 with the lifting arm 402 in front of the seated person 900. The helper 902 may then extend the lifting arm 402 to an extended position if the lifting arm 402 is in a non-extended position. (Note that in some embodiments the lifting arm 402 may be permanently fixed in an extended position so that this step need not be performed.) The seated person 900 then may grip some point of the walker 100, such as the top support 108, the top of the back legs 106, the top of the front legs 104, the cross support 112, or, preferably in some embodiments, the lower part of the lifting arms 402. The helper 902 then may grip the upper part of the lifting arm 402, and, taking advantage of the mechanical advantage (i.e., the leverage) that the lifting arm 402 provides, the helper 902 may pulls backwards, as shown in FIG. 10.

As the helper 902 pulls backward, the walker 100 generally will pivot at a point where the front legs 104 touch the ground. The shoes 107 of the front legs 104 may prevent sliding from occurring at this pivot point given the downward pressure associated with the pulling action and the tackiness of the shoes 107. The shoes 107 further may be arcuate in shape or have rounded edges so that the shoes 107 pivot more efficiently.

Figure 11:
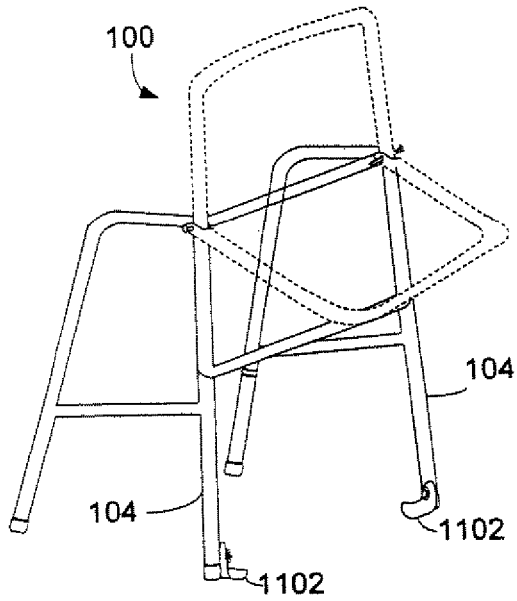
FIG. 11 demonstrates an embodiment of a footpad that may be used in certain embodiments of the present invention.
Figure 12:
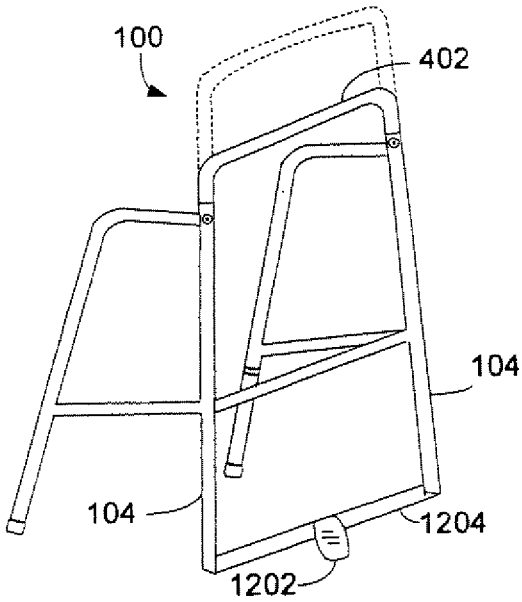
FIG. 12 demonstrates an embodiment of a footpad that may be used in certain embodiments of the present invention.

In alternative embodiments, a footpad may be placed at the bottom of one or both of the front legs 104. As shown in FIG. 11, the footpad 1102 may provide a surface area that may be depressed by either the foot of the helper 902 or the seated person 900 when the helper 902 pulls backward to assist the seated person. The footpad may be configured so as to receive at least a portion of the helper's foot. The footpad 1102 may be attached to the walker 100 per methods known in the art and may be located just above the shoe 107 of one or both of the front legs 104. The footpad 1102 may allow the helper 902 to provide additional downward force to ensure that the front legs 104 do not slide while the helper 902 pulls backward to assist the seated person 900 to stand. In some embodiments, the footpad 1102 may be attached to the walker 100 by a hinged connector (not shown). Attaching the footpad 1102 by a hinged connector allows the footpad to remain steady on the ground while the front legs pivot when the helper 902 pulls in a direction away from the seated person. The hinged connector may also allow the footpad 1102 to be in a "down" position (in which the footpad 1102 may be substantially parallel to the ground) when the footpad 1102 is being used, and stored in an "up" position (in which the footpad 1102 may be substantially perpendicular to the ground) when the footpad 1102 is not being used. In alternative embodiments, a central footpad 1202 may be used, as demonstrated in FIG. 12. The central footpad 1202 may be attached to a footpad support 1204 that attaches to the bottom of each of the front legs 104. In yet other embodiments, one or more footpads may be attached to the rear legs for use by the seated person as discussed further herein.

As the helper 902 pulls backward, the seated person 900 continues to hold on to the walker 100 or lifting arm 402, whatever the case may be. The pulling force of the helper 902 is magnified by the leverage associated with the lifting arm 402 and this force is transferred to the seated person 900. Thusly the seated person 900 is pulled to a standing position. The leverage provided by the lifting arm 402 allows a small amount of pulling force from the helper 902 to provide a significant amount of pulling force to assist the seated person 900 to stand. In some embodiments, as little as 25 lbs. of pulling force may assist a 200 lb. person to stand from a seated position. Further, the helper 902 is pulling in a manner that is ergonomically safe and, thus, unlikely to cause injury to the helper 902. This is because the lifting arm 402 allows the helper 902 to pull while standing in an upright position with a straight back. In addition, the stability of the standing process is enhanced by the walker 100, thus reducing the risk of falls. The reverse of this procedure may be performed to allow a standing person to attain a seated position in a controlled and safe manner.

In an alternative embodiment, the walker device may be a rollator 1300, as described above and shown in FIG. 13, having at least three wheels 1310 in communication with the ground. In this embodiment, one or more lifting arms 1305 may be affixed to the rollator 1300 in any configuration as describe above, such as the lifting arm 1305 in FIG. 1B, the lifting arm 402 in FIG. 4A, the lifting arm 502*a* in FIG. 5A, or the lifting arm 602 in FIG. 6. More specifically, a four-wheeled rollator 1300 may include two front legs 1350, two back legs 1360, and may further include two handles 1320 extending horizontally and toward the user. The lifting arm 1305 may attach at a position at or near the top of one of the front legs 1350 or one of the back legs 1360 and extend in an approximate vertical direction. It is appreciated that in a configuration including two lifting arms, one lifting arm 1305 may attach to each of the front legs 1350 of the rollator 1300. Alternatively, the lifting arm 1305 may attach at a position on one handle 1320 and extend in an approximate vertical direction, or in a configuration including two lifting arms, one lifting arm 1305 may attach to each of the two handles 1320. The lifting arm 1305 may be configured in any of the manners described herein. For example, the lifting arm 1305 may be telescopically integrated with each front leg 1350 of a four-wheeled rollator 1300 in a manner similar to that described in reference to FIG. 2A. Alternatively, the lifting arm 1305 may be removably attached to one of the front legs 1350, one of the back legs 1360, or one of the handles 1320 of the rollator 1300 like that described in reference to FIGS. 7-8.

A rollator 1300 having one or more lifting arms 1305 may be used as in the description accompanying FIGS. 9-10 above and FIGS. 17A and 17B below, where the helper 902 grips at or near the distal portion of the lifting arm 1305 and the seated person 900 grips either the rollator 1300 or the lifting arm 1305 at a position sufficiently below that of the helper 902. However, in this embodiment, it may be beneficial to lock at least the two front wheels 1310 of the rollator 1300 so it does not roll while assisting the seated person 900 to stand. The wheels 1310 may be manually locked by locking mechanisms 1340 positioned at one or more wheels 1310 by methods known in the art. Alternatively, the wheels 1310 may be locked via an actuator positioned at some point on the rollator 1300, for example a braking mechanism 1330 at or near the handles 1320, at a point on the front legs 1350, or at any other point on the rollator 1300. It is appreciated that any means currently known in the art may be employed for manually locking a wheel. Examples of braking means or locking means (which may collectively describe the locking mechanism 1340 and braking mechanism 1330) that may be integrated with the mobility devices described herein may be a lever forcibly restricting the rotation of the wheels, a rim brake having a brake pad and caliper for exerting force on a surface of the wheel, a disc brake having a brake pad and a caliper for exerting force on a disc attached to the wheel, or the like, as is known in the art. After locking at least the front wheels 1310 of the rollator, the helper 902 may pull the lifting arm 1305 away from the seated person 900, assisting the seated person 900 to stand. After standing, the wheels 1310 may be unlocked, and the rollator 1300 used to aid in mobility.

Figure 14:
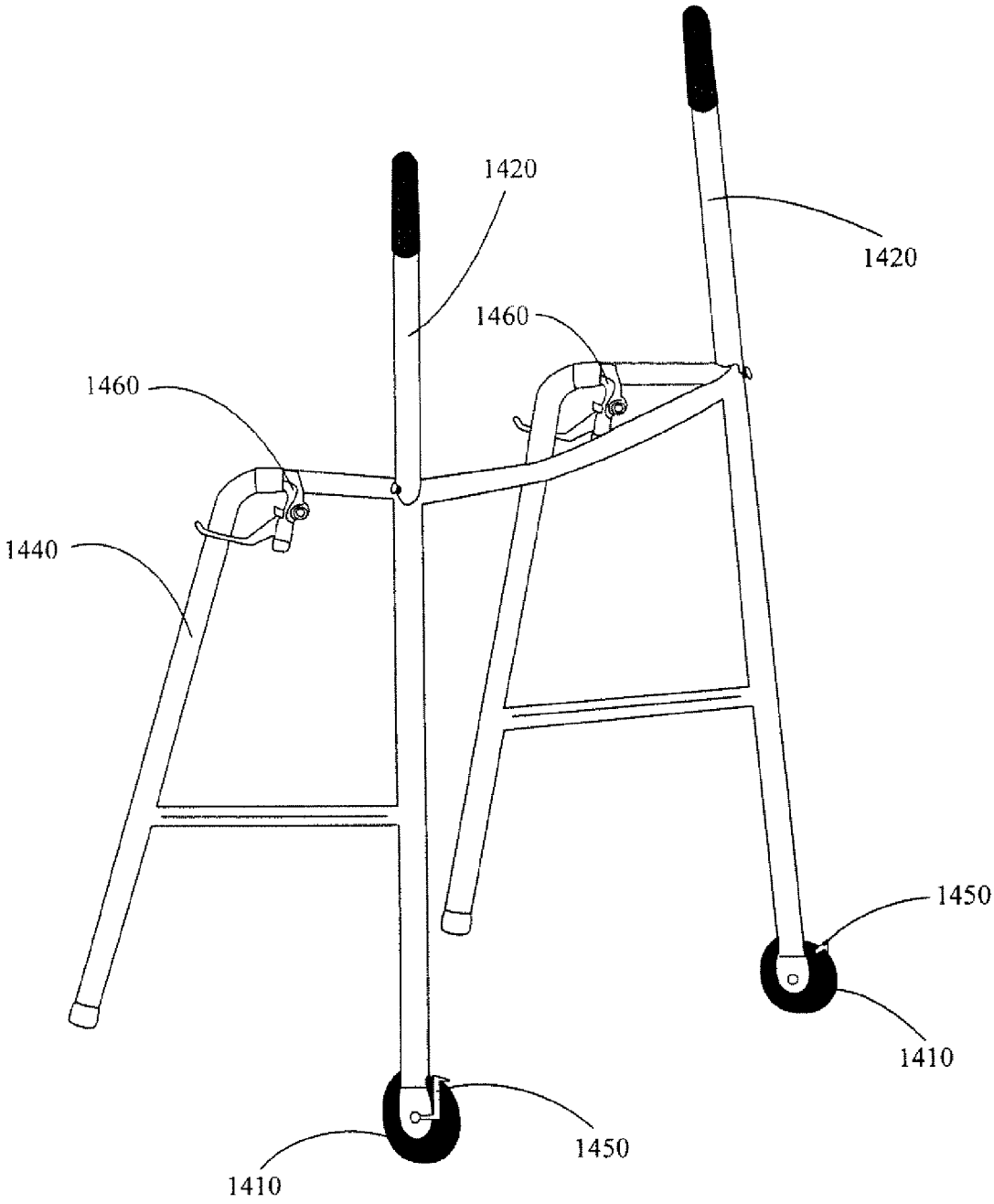
FIG. 14 demonstrates an embodiment of a wheeled mobility device in accordance with the present invention.

In an embodiment similar in configuration to both the rollator 1300, described in reference to FIG. 13, and the walker 100, described in reference to FIGS. 1A and 1B, the walker device may be a wheeled walker 1400, as shown in FIG. 14. The wheeled walker 1400 may be configured like a traditional walker as described above, but also including two wheels 1410 on either the front two legs 1430 or the back two legs 1440 to assist in moving the wheeled walker 1400 when in use as a mobility aid. It is appreciated that in other embodiments, a wheeled walker 1400 may include four wheels 1410, one each on the two front legs 1430 and the two back legs 1440. The lifting arm 1420, configured like the lifting arm 102 in FIG. 1B, the lifting arm 402 in FIG. 4A, the lifting arm 502*a* in FIG. 5A, or the lifting arm 602 in FIG. 6, may attach at a position at or near the top of the leg and extend in an approximate vertical direction. It is appreciated that in a configuration including two lifting arms, one lifting arm 1420 may extend from each of the front legs 1430 of the walker. Additionally, the wheeled walker 1400 may include locking mechanisms 1450, (like locking mechanisms 1340 described above in reference to FIG. 13), to allow locking at least one of the two wheels 1410. More preferably, both wheels may be locked by locking mechanisms 1450. The locking mechanisms 1450 may be locked manually (as described in reference to FIG. 13) or alternatively, they may be locked by an actuator or breaking mechanism 1460 positioned at or near the position on the wheeled walker 1400 where the user may grip the walker. In use, the wheeled walker 1400 may be used much like that described for the rollator 1300 above.

Figure 15:
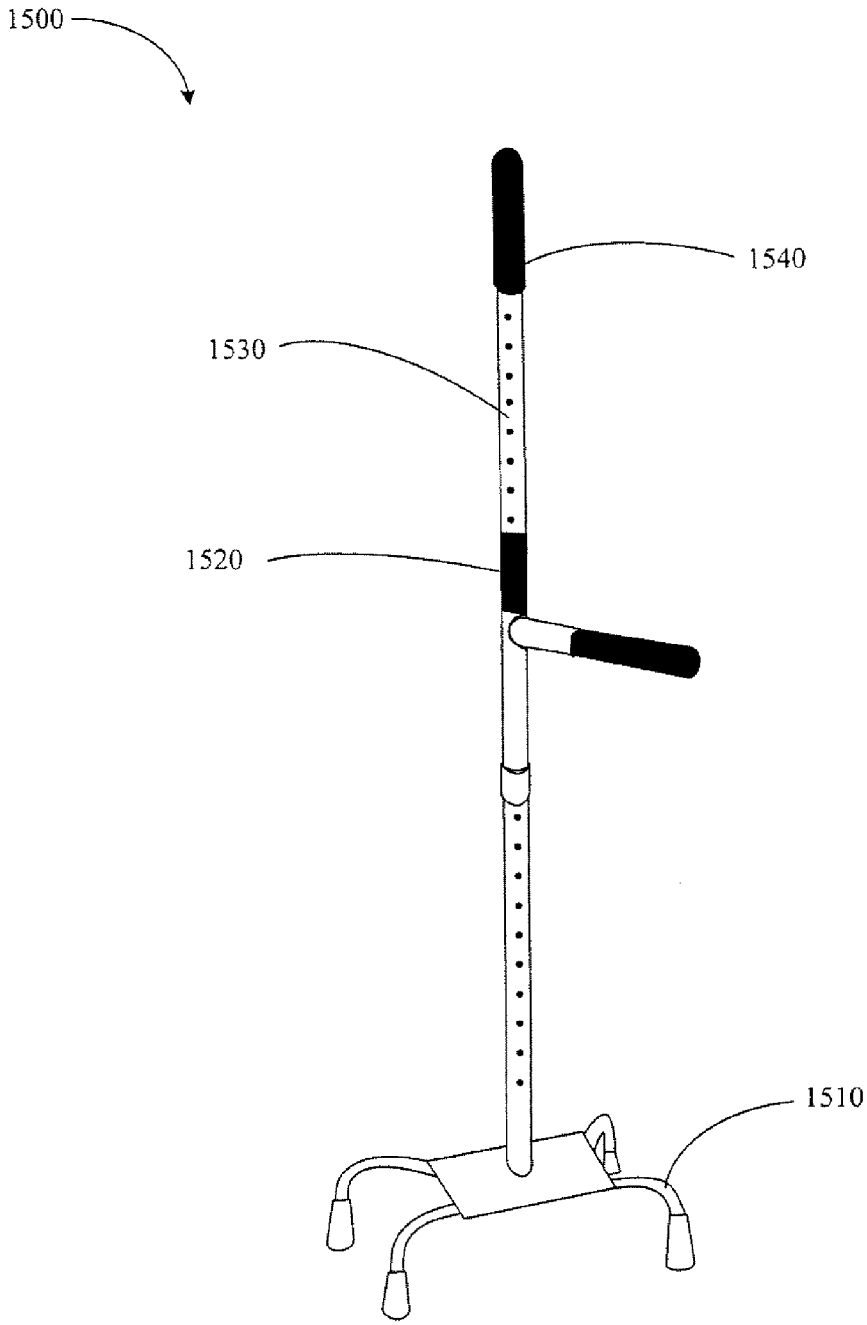
FIG. 15 demonstrates an embodiment of a walker device in accordance with the present invention.
Figure 16A:
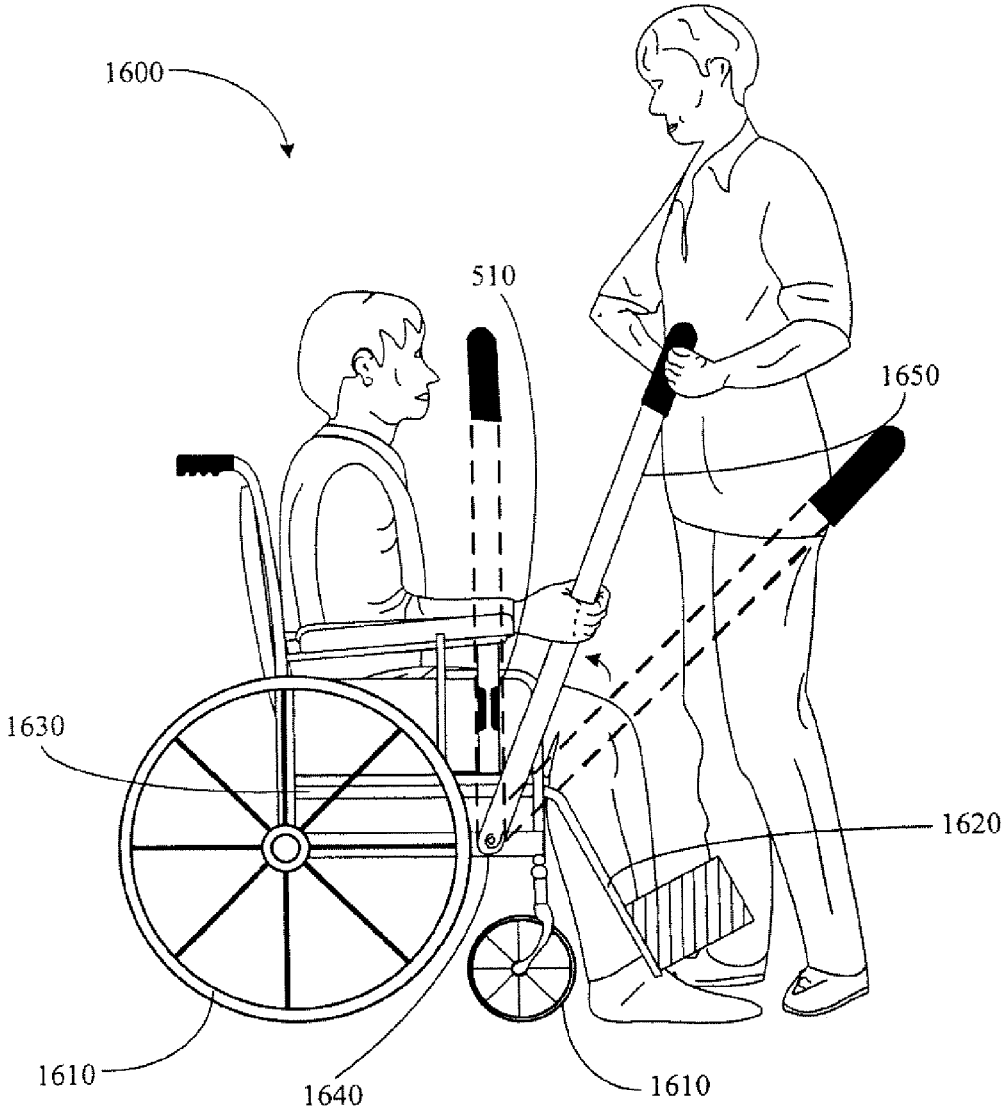
FIGS. 16A-16C demonstrate several views of alternative embodiments of a wheeled mobility device in accordance with the present invention.
Figure 16B:
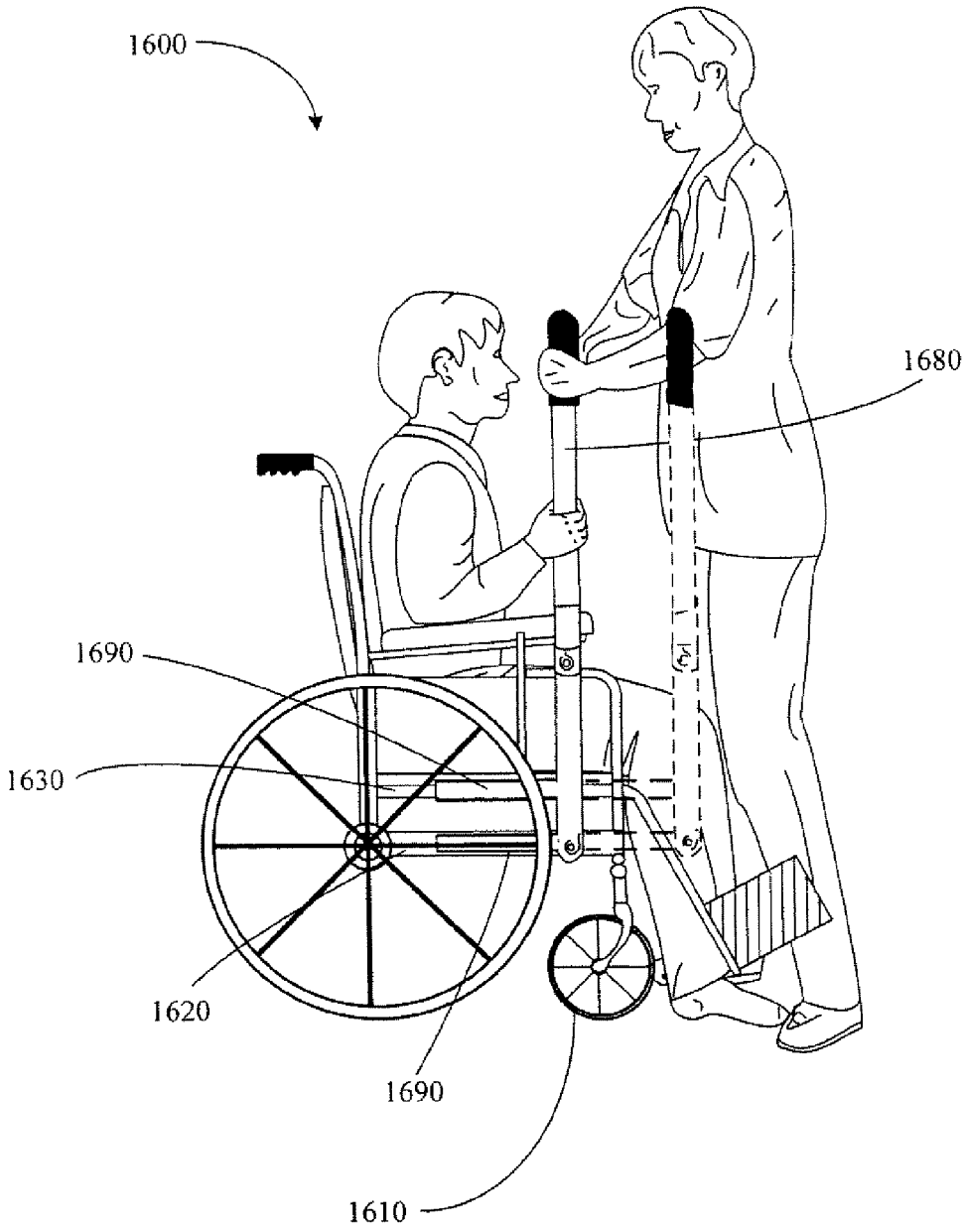

In an alternative embodiment, the walker device may be a multiple-legged cane 1500 in communication with the ground as illustrated in FIG. 15. A multiple-legged cane 1500 may have three or more legs 1510 as support points in contact with the ground. In this embodiment, a lifting arm 1530 may be attached to the cane 1500 in any configuration as described above. More specifically, the lifting arm 1530 may be attached or integrated at or near the distal end of the cane 1500. For example, the lifting arm 1530 may be telescopically integrated with the cane 1500 in a manner similar to that described in reference to FIG. 2A. Alternatively, the lifting arm 1530 may be removably attached to the cane 1500 like that described in reference to FIGS. 7A-8C. Additionally, the lifting arm 1530 may include a gripping handle 1540 as described above positioned at or near the distal end and configured to receive at least one hand of the helper. A second gripping handle 1520 may further be included in the lifting arm 1530, positioned at a point below the first gripping handle 1540 and sufficiently separated so as to produce sufficient leverage when pulling the lifting arm 1530 toward the helper and away from the seated person. In use, the helper may grip at or near the distal end of the lifting arm 1530 while the seated person grips the cane or the lifting arm 1530, preferably with both hands, at a position sufficiently lower than that of the helper. The helper may grip with one or both hands and pull the lifting arm 1530, and thus the cane 1500, away from the seated person, assisting the seated person to stand.

Figure 16C:
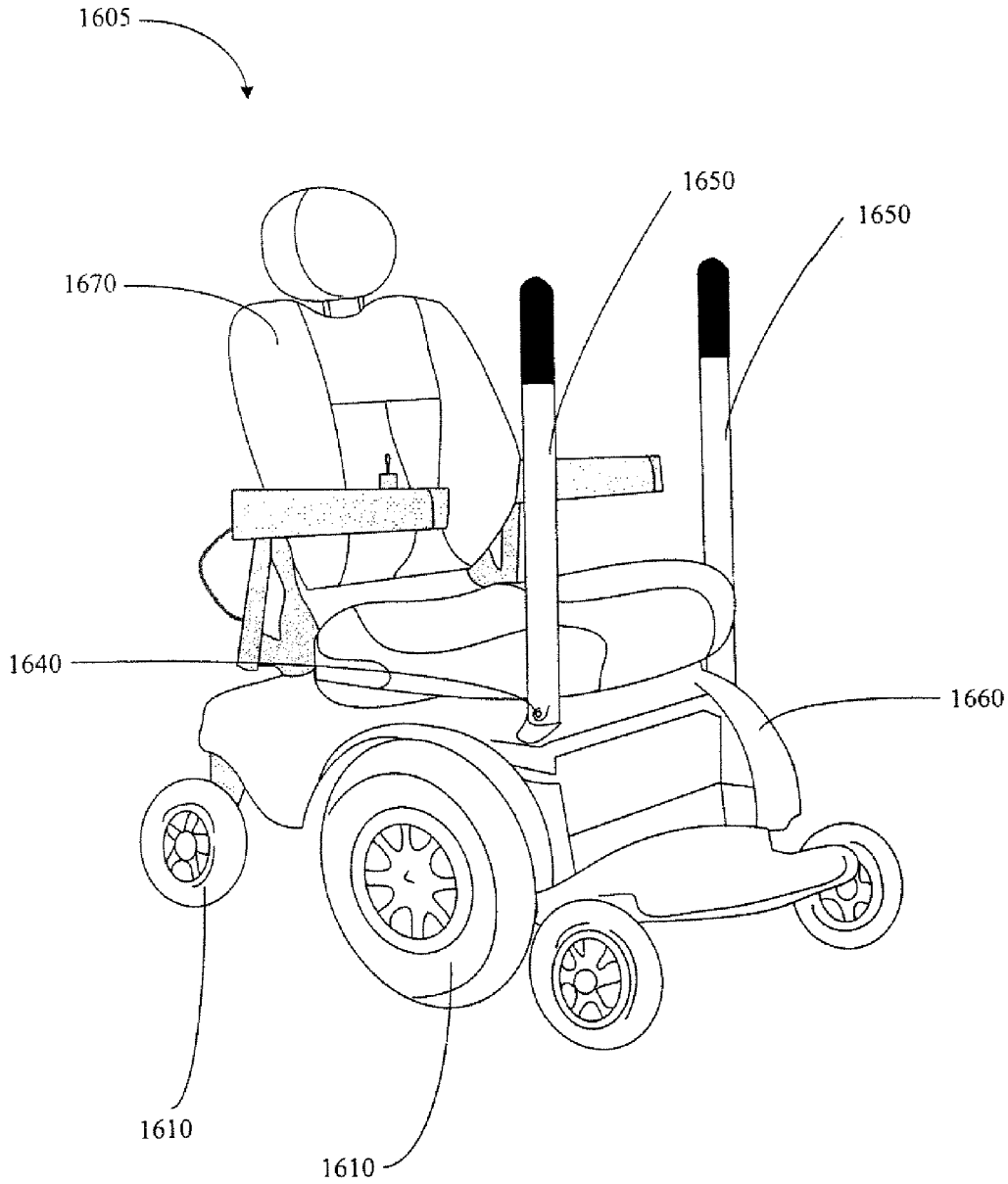

In an alternative embodiment, one or more lifting arms may be integrated with a wheeled mobility device as shown in FIGS. 16A-16C. A lifting arm 1650 may be attached to a wheeled mobility device, such as a wheelchair 1600, as illustrated in FIGS. 16A and 16B. For example, the wheelchair 1600 may include a lower support structure 1620 extending downward in an approximate vertical direction. The lower support structure 1620 may be the member to which the front wheels 1610 attach or the member to which the footrests may attach. The lifting arm 1650 may attach at any point along the lower support structure 1620, preferably near the bottom end, and extend substantially upward in an approximate vertical direction. Alternatively, the wheeled mobility device, for example the wheelchair 1600, may include a middle support structure 1630 configured to support the seat. The lifting arm 1650 may attach at a point on the middle support structure 1630 at or near the front of the middle support structure 1630. However, it is appreciated that other members of the wheelchair 1600 may be used for attaching the lifting arm 1650. The lifting arm 1650 may be configured to be long enough to extend to a position at or near, and preferably above, the shoulders of the seated person when seated, providing sufficient separation between the position where the helper grips and where the seated person grips so as to create enough leverage to assist the seated person to stand.

In this embodiment, the lifting arm 1650 may be attached by a hinged connector 1640 so as to allow the lifting arm 1650 to pivot in a forward and backward direction (toward the wheelchair and away from the wheelchair). Furthermore, the lifting arm 1650 may be configured to have a telescoping portion that will allow reducing the length when not in use and allow for selecting a comfortable and effective length for the helper and the seated person. The lifting arm 1650 may also be removably attached to either the lower support structure 1620 or the middle support structure 1630 to allow for removal when not in use. The lifting arm 1650 or the wheelchair 1600 may include one or more the attaching means, such as the attaching means 510 as described in reference to FIG. 5D, to allow securing the lifting arm 1650 to one or more points on the wheelchair 1600 when not in use. For example, the lifting arm 1650 may include two attaching means that engage with a structure on the wheelchair 1600 to allow securing the lifting arm 1650 to the wheelchair 1600. The lifting arm 1650 may be removed and secured to either the lower support structure 1620, the middle support structure 1630, or another point on the wheelchair 1600. The lifting arm 1650 configured with a telescoping portion as described above may also be removed and attached to a point or points on the wheelchair.

Alternatively, the wheelchair 1600 may include one or more lifting arms 1680 attached in a manner as illustrated in FIG. 16B. The lifting arms 1680 of this embodiment may include at least one rigid connecting member 1690 that is configured to attach to at least one point on the wheelchair 1600. The embodiment illustrated in FIG. 16B is configured with two rigid connecting members 1690 connecting to two points on the wheelchair 1600. The rigid connecting members 1690 may be configured to allow the lifting arm or arms 1680 to be removably attached to the wheelchair 1600, such as at the lower support structure 1620 and/or the middle support structure 1630. The rigid connecting members 1690 may be slidably inserted into or around the support structure of the wheelchair or, alternatively, they may be removably attached by way of one or more attaching means, such as attaching means 510 as described in reference to FIG. 5D. Slidably connecting the lifting arm 1680 to the wheelchair 1600, as is shown by example in FIG. 16B, allows the lifting arms 1680 to be fully inserted into the support members of the wheelchair, and thus rest at or near the wheelchair, reducing interference by the lifting arm 1680 when not in use, while allowing them to be extended to a position that is comfortable and effective for both the helper and the seated person when in use.

Additionally, as illustrated in FIG. 16B, the lifting arm or arms 1680 may further be configured so a portion of the lifting arm 1680 may telescopically extend and retract into itself. This telescopic configuration allows the lifting arm 1680 to be retracted when not in use to avoid interference during normal operation of the wheelchair 1600, and selectively extended to a position that is comfortable and effective for the helper and the seated person when in use.

In use, the lifting arms 1680, as illustrated in FIG. 16B, are rigidly connected with reference to the wheelchair 1600. Thus, when acted upon and pulled in a direction toward the helper, the entire wheelchair 1600 pivots forward, lifting the seated person to a standing position as the wheelchair 1600 pivots. In one example embodiment, the front wheels of the wheelchair 1600 may be locked, allowing the wheelchair 1600 to pivot about the front wheels, and preventing the wheelchair 1600 from rolling when using the lifting arms 1680. However, it is appreciated that the lifting arms 1680 illustrated in FIG. 16B may alternatively be hingedly attached to a single rigid connector 1690, thus allowing the lifting arm 1680 to rotate at the point of the hinged connection to the rigid connector 1690 while the wheelchair 1600 remains steady.

In another example embodiment, as illustrated in FIG. 16C, a wheeled mobility device may be configured as a motorized scooter 1605, as is known in the art. The motorized scooter may include at least three wheels 1610. Further, the motorized scooter may include a lower support structure 1660 to which a seat 1670 may attach. Further, the lifting arm 1650 may be hingedly attached by a hinged connector 1640 to a point on the lower support structure and extend in an approximate vertical manner. The lifting arm 1650 may be configured in a telescoping manner, like that described in reference to FIG. 2A, so when in use the lifting arm 1650 may extend sufficiently, and when not in use it may retract and be stored at a point on the motorized scooter 1605.

In using this embodiment, the helper may grip the lifting arm 1650 at a position at or near the top, and the seated person may grip the lifting arm 1650 at a position below and sufficiently separated from the helper. The helper then may pull back the lifting arm 1650, causing it to pivot about the hinged connector 1640, while the seated person also pulls the lifting arm 1650 while standing. It is preferable that one or more wheels 1610 of the wheeled mobility device be locked when using the lifting arm so as to prevent the wheeled mobility device from shifting underneath the seated person while in use.

Figure 17A:
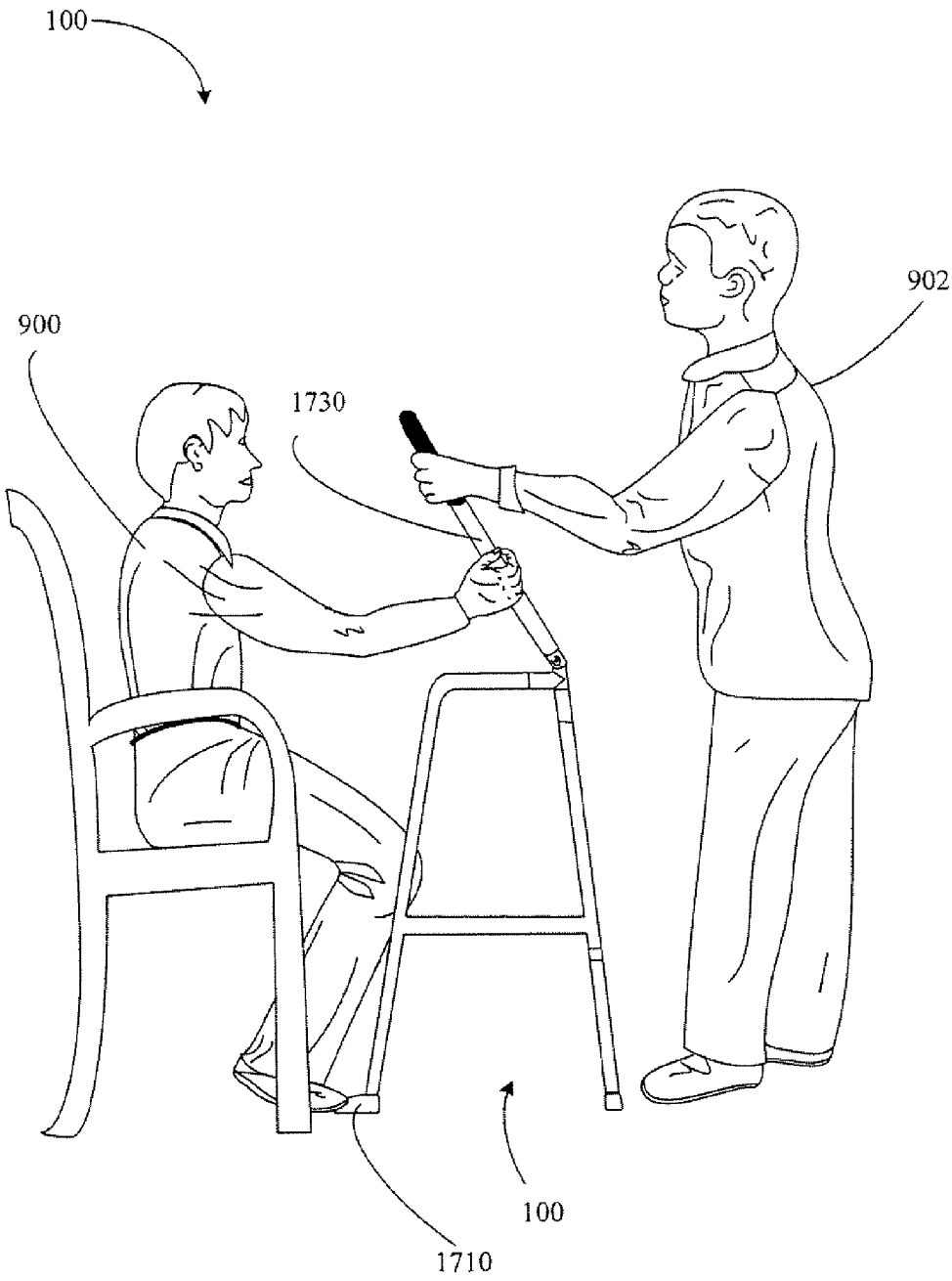
FIGS. 17A-17B demonstrate an embodiment of a walker device in accordance with the present invention in use.
Figure 17B:
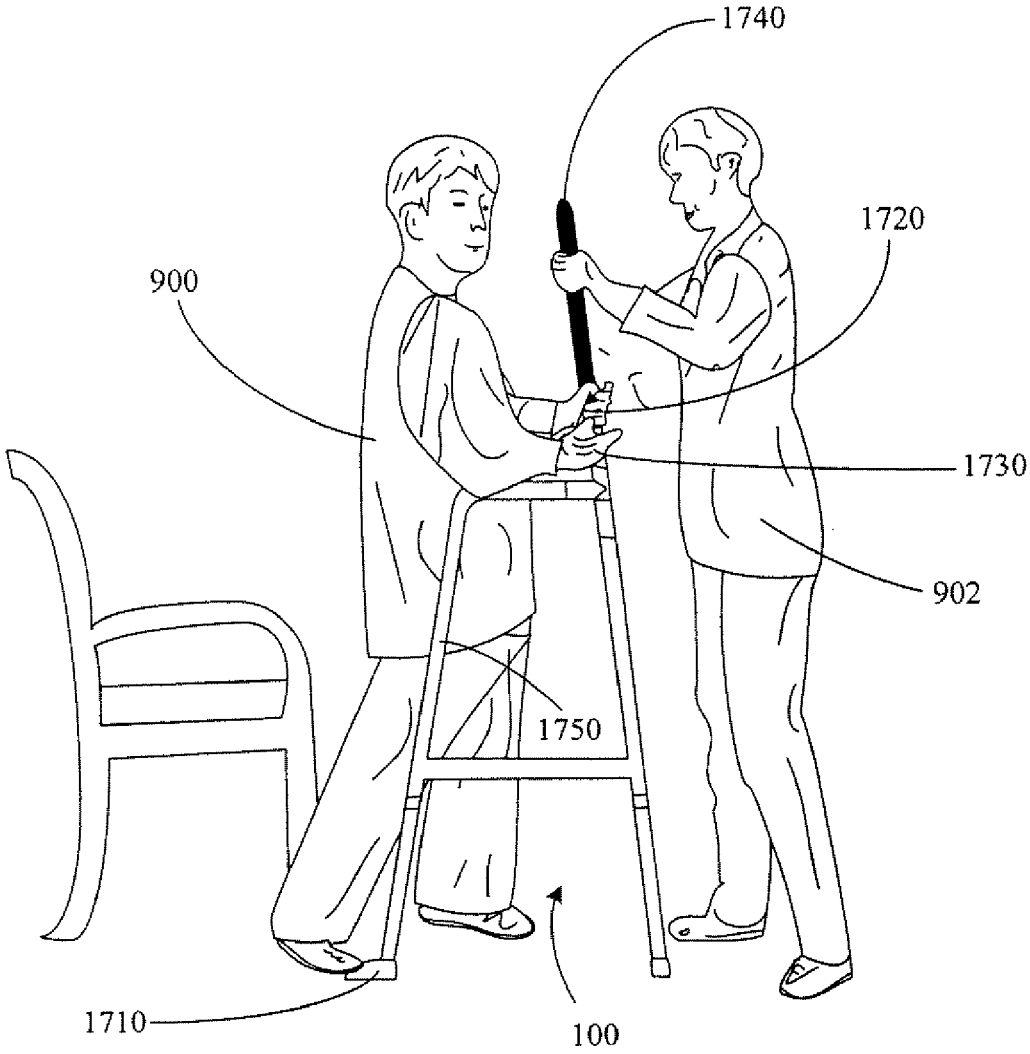

In an alternative embodiment, shown in FIGS. 17A and 17B, that includes a lifting arm 1730 connected to a walker 100, or other walking aid, in a hinged manner, both the helper 902 and the seated person 900 grip the lifting arm while the helper 902 pulls backward on the lifting arm 1730 causing only the lifting arm 1730 to pivot. The walker 100 may be, for example, like the walker described in reference to FIG. 1B. In use, the helper 902 grips the lifting arm 1730 at or near the distal end of the lifting arm 1730, and the seated person 900 grips the lifting arm 1730 at a position lower than where the helper 902 grips. The lifting arm 1730 is of a sufficient length so as to allow enough separation between the helper's hands and the seated person's hands to create sufficient leverage when the helper 902 pulls back. Furthermore, in this configuration, the lifting arm 1730 may be rotated toward the seated person 900 to reduce any distance the seated person 900 must extend to grip the lifting arm 1730, as shown in FIG. 17A.

In one variation of this embodiment, the walker 100 may include one or more footpads 1710 attached to the back legs 1750 of the walker 100, similar to the footpad 1102 as shown in FIG. 11. However, in this embodiment, the seated person 900 may place a foot on the footpad 1710, so as to prevent the walker 100 from pivoting while the helper 902 pulls back on the lifting arm 1730, as shown in FIG. 17B. The footpad 1710 may be designed so the bottom is substantially flat to create a steady surface when in contact with the ground. Furthermore, the footpad may be made retractable by mounting via a hinge or the like, as is known in the art, so it may be rotated off the ground so as to not interfere when the walker 100 is used for walking.

A walker 100 configured for use in the manner described in reference to FIGS. 17A and 17B may have more than one gripping handle on each lifting arm, where a first gripping handle 1740 is positioned at or near the distal end of the lifting arm and a second gripping handle 1720 is positioned sufficiently lower than the first gripping handle 1740. In this configuration, the helper 902 may grip the first gripping handle 1740 and the seated person 900 may grip the second gripping handle 1720. The lifting arm 1730 may be attached by a hinged connector at any point on the walker structure between the bottom and the top of the walker 100. For example, a lifting arm 1730 may be connected at or near the bottom of one or both of the two front legs and extend above the top of the walker 100. In this configuration, the lifting arm 1730 may have a telescoping portion that will allow reducing the length when not in use. In another example, the lifting arm 1730 may be attached to the top of the two front legs as is shown in FIGS. 17A and 17B.

Figure 18:
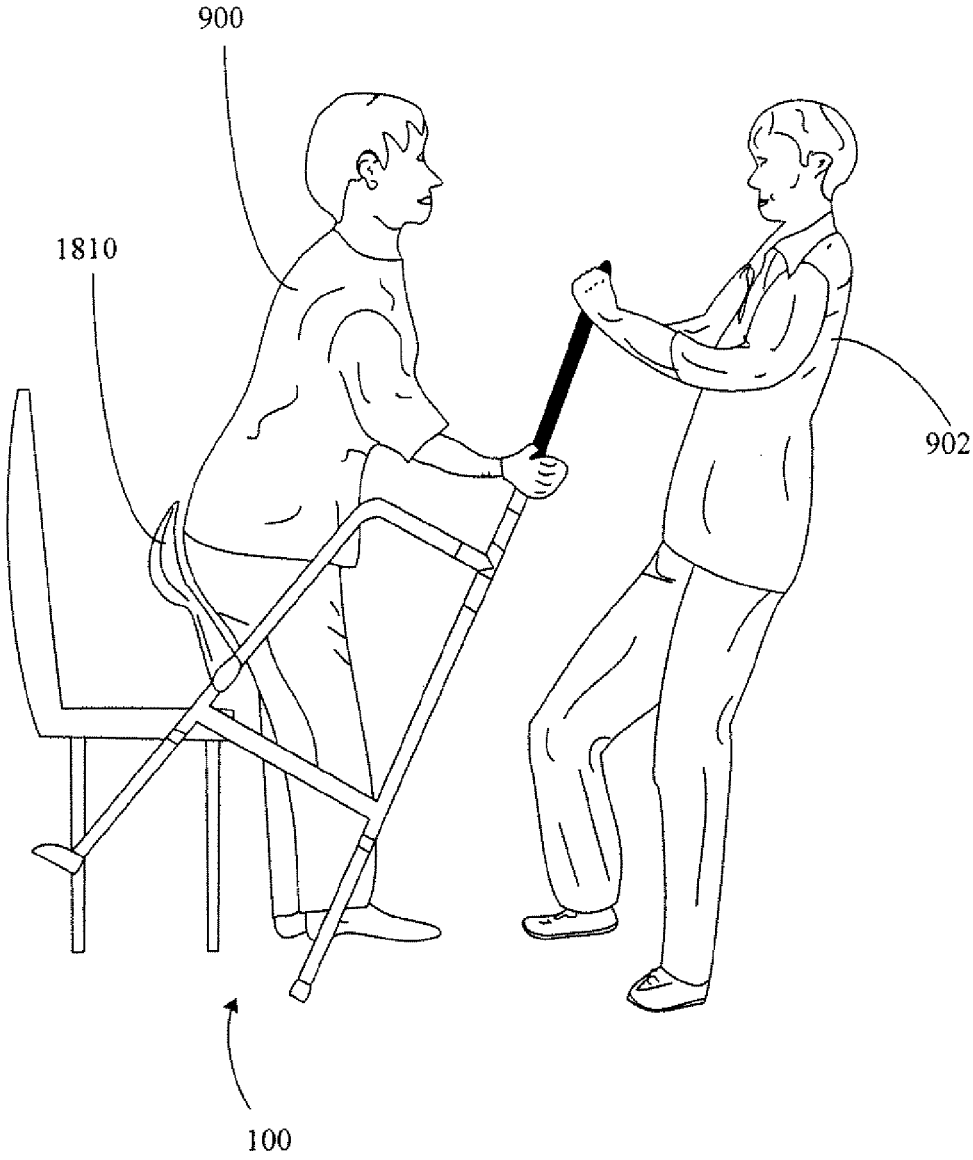
FIG. 18 demonstrates an embodiment of a walker device that includes a sliding board in accordance with the present invention in use.

In an alternative embodiment, illustrated in FIG. 18, a walker 100 may also include one or more removable sliding boards 1810 that may be attached to the walker 100 and configured to be positioned at some point behind the seated person 900 when in use. More specifically, the sliding board 1810 may be a substantially flat, rigid structure that can be removably connected to the back legs of the walker and configured so that when connected it slides at least partially underneath the seated person's upper leg or legs. Thus, when the sliding board 1810 is attached to the walker 100 and in place, as the helper 902 pulls the walker 100 back, the sliding board 1810 also acts to lift the seated person 900 by exerting a force against the back of the seated person's legs. The sliding board 1810 need not provide complete assistance to the seated person 900. Steadying the seated person 900 and creating at least an additional force lifting the person from a seated position are beneficial. After lifting the seated person 900 to a standing position, the helper 902 or the seated person 900 may remove the sliding board 1810 and attach it to the walker 100, using one or more attaching means, like the attaching means 510 as illustrated in FIG. 5D. Alternatively, the sliding board 1810 may be configured to be positioned behind other areas of the seated person's body, such as the lower back, upper arms, buttocks, or the like.

Figure 19:
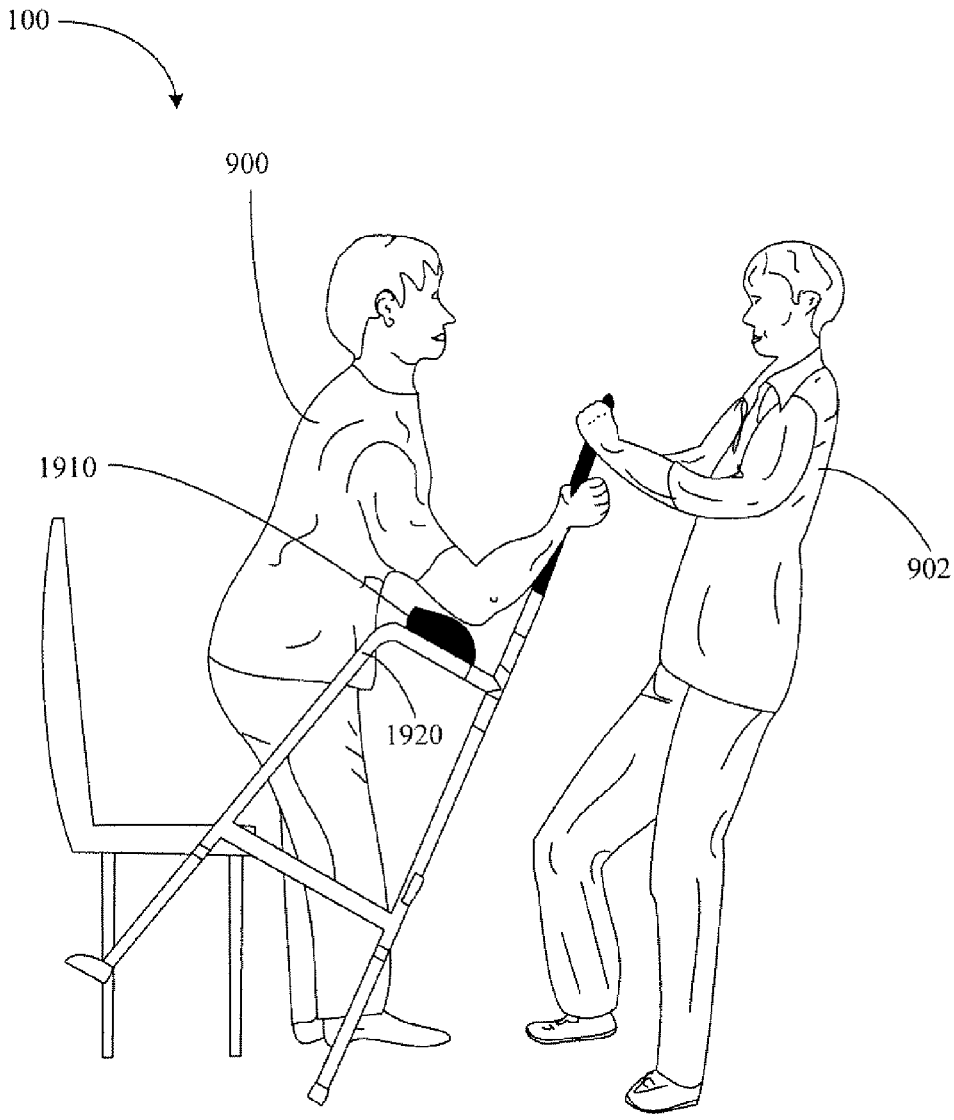
FIG. 19 demonstrates an embodiment of a walker device that includes elbow pads in accordance with the present invention in use.

As illustrated in FIG. 19, the walker 100 may further contain at least one elbow pad 1910 affixed to each top support 1920. The elbow pads 1910 may be configured in a substantially concave shape to receive at least partially the elbows and/or the forearms of the seated person while he/she grips the lifting arms or the walker. When the helper pulls the lifting arm back, the elbow pads 1910 provide extra stability to the seated person and also provide additional force to assist the seated person to stand. Thus, when the helper pulls back, the walker 100 effectively pushes up on the seated person exerting force on the seated person's elbows and/or forearm ms. The elbow pads 1910 also create the added benefit of reducing the force by which the seated person must grip the lifting arm or walker 100 while standing. The elbow pads 1910 may be constructed from a soft, pliable material, such as foam, rubber, or other polymer, or the like, as is known in the art, so as to provide a comfortable receptacle for the seated person's elbow and/or forearm m, while also providing a higher friction surface to reduce the possibility of the seated person's elbow from slipping off of the elbow pad. Furthermore, the elbow pads 1910 may further include an attaching means, like the attaching means 510 as illustrated in FIG. 5D, allowing for removal from the top support and securing to another similarly sized support on the walker 100. Removable elbow pads 1910 provide the advantage of not interfering when the walker 100 is being used as a walking aid rather than a lifting aid.

FIGS. 20A-20C illustrate alternative embodiments of the gripping handles that may be included on the lifting arms attached to the walker 100, as described above. For example, in FIG. 20A, a lifting arm 2030 may include a gripping handle 2010. The gripping handle 2010 may be constructed as one or more handles extending outward in an approximate perpendicular direction from the lifting arm 2030. More specifically, the gripping handle 2010 may be two handles integrated with the lifting arm 2030 near its distal end and extending outward in opposite directions from each other. The gripping handle 2010 may have a coating so as to promote increased friction when gripping, such as rubber, plastic, or foam, or may be etched, similarly creating a high-friction surface. Further, the gripping handle 2010 allows for grasping by more than one person, for circumstances where it may be preferable to lift the seated person using two helpers.

FIG. 20B illustrates an alternative gripping handle 2020, configured as a handle or knob positioned at the distal end of the lifting arm 2030 attached to the walker 100, as described above. The gripping handle 2020 may be spherically shaped. Alternatively, the gripping handle 2020 may be shaped so as to comfortably fit within, and conform to, the palm of a helper's hand. The gripping handle 2020 may further serve to provide a surface for grasping when extending lifting arms 2030 that are configured in a telescoping manner, as well as preventing the lifting arms 2030 from sliding entirely within the legs of the walker 100 when being retracted.

In another example embodiment, the gripping handle 2020 may retract substantially within the legs of the walker when the lifting arms 2030 are configured in a telescopic manner, as shown in FIG. 20C. The gripping handle 2020 configured in this manner may still include a surface for grasping, such as is described with reference to other example embodiments. The lifting arms 2030 configured in this manner with a gripping handle that retracts substantially within the legs of the walker may further include a sliding knob 2040, configured as a knob or handle extending through a slot or aperture in the legs, and used for grabbing and manually aiding during extending or sliding the lifting arms 2030 from the legs.

FIG. 21 provides an illustrative embodiment of a method of manufacturing a walker device for assisting a seated person to stand. It should be appreciated that FIG. 21 is exemplary, and the same steps may be applied to any of the embodiments described herein. First, at block 2110, a walking aid is provided, as described in the many illustrative embodiments contained herein. For example, the walking aid may include at least two front legs and at least two back legs. Alternatively, the walking aid may be a rollator having three or four wheels, a wheeled walker having two wheels, a multiple-legged cane, or a wheeled mobility device such as a wheelchair or a scooter, as described herein. It is appreciated that during the method of manufacturing, the walker device may not necessarily be in final form and could be in an intermediate state of manufacture.

Next, at block 2120, at least one lifting arm is attached to the walking aid to extend in an approximate vertical direction from the walking aid. The lifting arm may be configured as in any of the example embodiments described herein. For example, the lifting arm may telescope, the lifting arm may be attached in a fixed or hinged manner, or the lifting arm may be removably attached. Additionally, the lifting arm may be configured to extend at least 12 inches in an approximate vertical direction from the walker.

Finally, at block 2130, a gripping handle is affixed to the lifting arm at an approximate distal end of the lifting arm. The gripping handle may be any gripping handle as in any example embodiment described herein. For example, the gripping handle may be comprised of foam, rubber, other polymers, or other similar materials, and may at least partially circumscribe the lifting arm, or may be constructed as an etched pattern, such as cross-hatching, in the surface of the lifting arm or a coarse coating on the surface of the lifting arm that creates a high-friction surface for gripping when in use, as is known in the art. Alternatively, the gripping handle may be configured as one or more handles extending in a perpendicular orientation from the axis of the lifting arm, or as a knob or other protrusion attached at or near the distal end of the lifting arm. Additionally, a second gripping handle may be attached to the lifting arm at a position sufficiently separated from the first gripping handle attached at block 2130.

It is appreciated that the ordering of steps described in reference to FIG. 21 may be altered and still be within the scope of the present invention. Other steps may be included in the method of manufacturing a walker device like any of the embodiments described herein. For example, the lifting arm may be configured like that described in reference to FIG. 6, including constructing a lifting arm having two vertical members positioned substantially parallel to each other and connected by a horizontal connector attached at their distal ends. In another example, the method of manufacturing may include the step of providing and attaching a footpad to one or more of the legs of the walking aid. The footpad may be attached in a manner that allows it to be retracted when not in use, for example by a hinged connector. In yet another example, the method of manufacturing may include the step of providing and affixing attaching means, such as a c-shaped clamping mechanism, at one or more points on the lifting arm or the walking aid. It is understood that the steps provided herein are exemplary, and that any steps are provided for manufacturing any exemplary embodiment described herein.

It should be apparent that the foregoing relates only to the preferred embodiments of the present invention and that numerous changes and modifications may be made herein without departing from the spirit and scope of the invention as defined by the following claims and the equivalents thereof.

What is claimed is:

1. A walker device for assisting a seated person to stand, comprising:

a walking aid comprising at least two horizontal and transversely spaced walking aid handles for gripping while using the walking aid for walking; and a substantially straight lifting arm extending at least 12 inches in an approximate vertical direction from the walking aid and comprising a gripping handle positioned at an approximate distal end of the lifting arm, wherein the approximate distal end terminates in a substantially straight configuration, wherein the lifting arm is moveable independent of the walking aid;

wherein the lifting arm is positioned above the horizontal walking aid handle and is configured to receive at least one hand of a helper at a first position;

wherein the walking aid is configured to receive at least one hand of the seated person at a second position separated from the first position; and wherein the first position and the second position are sufficiently separated to produce leverage so that the walking aid pivots about a front portion of the walking aid and lifts a back portion or the walking aid when the lifting arm is pulled in a direction away from the seated person by the helper, the lifting arm moves in a direction towards the helper, to assist the seated person to stand.

2. The walker device of claim 1, wherein the walking aid is a wheeled walker comprising two front legs and two back legs, wherein the two front legs or the two back legs comprise wheels positioned at their distal ends.

3. The walker device of claim 2, wherein the lifting arm extends from one of the two front legs.

4. The walker device of claim 2, wherein each of two front legs comprise a wheel attached at the distal ends and a locking mechanism to prevent rotation of the wheels when actuated.

5. The walker device of claim 1, wherein the walking aid is a rollator comprising two front legs and two back legs and the at least two handles extending from the two front legs or the two back legs, wherein each of the two front legs and the two back legs comprise a wheel attached at the distal ends.

6. The walker device of claim 5, wherein the lifting arm extends from one of the two front legs.

7. The walker device of claim 5, wherein the lifting arm extends from one or the two handles.

8. The walker device of claim 5, wherein each wheel positioned at the distal ends of the two front legs comprises a locking mechanism to prevent rotation of the wheels when actuated.

9. The walker device of claim 1, wherein the lifting arm is configured to pivot about a point of attachment to the walking aid in an approximate front to back direction, wherein the pivoting allows the lifting arm to be pivoted towards the seated person and towards the helper person.

10. The walker device of claim 9, wherein the gripping handle is a first gripping handle, and further comprising a second gripping handle sufficiently separated from the first gripping handle configured to receive at least one of the seated person.

11. A method for manufacturing a walker device for assisting a seated person to stand, comprising:

providing a walking aid comprising a pair of interconnected front legs, a pair of back legs, each front leg connected to a respective back leg by a top support, providing the walking aid having at least two walking aid handles, wherein the walking handles are transversely spaced and horizontal, and extending toward the back legs attaching at least one substantially straight lifting arm extending at least 12 inches in an approximate vertical direction from the walking aid, wherein the at least one lifting arm is moveable independent of the walking aid, wherein the lifting arm positioned above the walking aid handles; and affixing a gripping handle to an approximate distal end of the at least one lifting arm configured to receive at least one hand of a helper at a position in front of the walking aid, wherein the approximate distal end terminates in a substantially straight configuration, wherein the walking aid is allowed to pivot about a front portion of the walking aid and to tilt the back portion of the walking aid when the lifting arm is pulled in a direction away from a seated person by the helper to assist the seated person to stand.

12. The method of claim 11, further comprising constructing at least one front leg to receive the at least one lifting arm in an area within the at least one front leg, wherein the at least one lifting arm and the at least one front leg are operable to allow the at least one lifting arm to telescopically extend from within the at least on front leg.

13. The method of claim 11, further comprising removably attaching the at least one lifting arm.

14. The method of claim 11, further comprising constructing the at least one lifting arm to comprise a first vertical member, a second vertical member substantially parallel to the first vertical member, and a horizontal connector connecting the first vertical member and the second vertical member, and attaching a distal end of the first vertical member to one of the front legs and attaching a distal end of the second vertical member to the other front leg.

* * * * *